US011790859B2

(12) United States Patent
Liu et al.

(10) Patent No.: US 11,790,859 B2
(45) Date of Patent: Oct. 17, 2023

(54) SOURCE DRIVING CIRCUIT, DISPLAY DEVICE, AND PIXEL DRIVING METHOD

(71) Applicant: SeeYa Optronics, Co., Ltd., Shanghai (CN)

(72) Inventors: Ping-Lin Liu, Shanghai (CN); Haodong Zhang, Shanghai (CN)

(73) Assignee: SeeYa Optronics, Ltd., Shanghai (CN)

( * ) Notice: Subject to any disclaimer, the term of this patent is extended or adjusted under 35 U.S.C. 154(b) by 0 days.

(21) Appl. No.: 17/797,706

(22) PCT Filed: Mar. 26, 2021

(86) PCT No.: PCT/CN2021/083263

§ 371 (c)(1),
(2) Date: Aug. 4, 2022

(87) PCT Pub. No.: WO2022/141843

PCT Pub. Date: Jul. 7, 2022

(65) Prior Publication Data

US 2023/0154414 A1 May 18, 2023

(30) Foreign Application Priority Data

Dec. 28, 2020 (CN) ..... 202011572901.X

(51) Int. Cl.
*G09G 3/3283* (2016.01)
*G09G 3/3233* (2016.01)

(52) U.S. Cl.
CPC ..... *G09G 3/3283* (2013.01); *G09G 3/3233* (2013.01); *G09G 2300/0426* (2013.01);
(Continued)

(58) Field of Classification Search
CPC ..... G09G 3/3233; G09G 3/3283; G09G 2300/0861; G09G 2300/0819;
(Continued)

(56) References Cited

U.S. PATENT DOCUMENTS 10,529,279 B1 1/2020 Rutherford
2007/0035487 A1* 2/2007 Ryu ..... G09G 3/3233 345/76

(Continued)

FOREIGN PATENT DOCUMENTS

CN 1912978 A 2/2007
CN 101325029 A 12/2008

(Continued)

OTHER PUBLICATIONS

International Search Report dated Sep. 3, 2021, in connection with International Application No. PCT/CN2021/083263.

(Continued)

*Primary Examiner* — Jimmy H Nguyen
(74) *Attorney, Agent, or Firm* — Wolf, Greenfield & Sacks, P.C.

(57) ABSTRACT

Provided are a source driving circuit, a display device and a pixel driving method. The source driving circuit includes a voltage isolation circuit, a voltage follower circuit, a first voltage dividing circuit, a second voltage dividing circuit, a first switch circuit, a second switch circuit, a third switch circuit, a fourth switch circuit, a fifth switch circuit, a sixth switch circuit and a current source.

16 Claims, 13 Drawing Sheets

(52) U.S. Cl.
CPC ..... *G09G 2300/0819* (2013.01); *G09G 2300/0842* (2013.01); *G09G 2300/0861* (2013.01); *G09G 2310/08* (2013.01)

(58) Field of Classification Search
CPC ... G09G 2300/0426; G09G 2300/0842; G09G 2310/08
USPC ..... 345/76, 212
See application file for complete search history.

(56) References Cited

U.S. PATENT DOCUMENTS

| | | | | |
|---|---|---|---|---|
| 2007/0075939 | A1* | 4/2007 | Cho | G09G 3/3233 345/76 |
| 2009/0174645 | A1 | 7/2009 | Kim et al. | |
| 2013/0120338 | A1* | 5/2013 | Kubota | H10K 59/123 257/E33.044 |
| 2015/0042692 | A1* | 2/2015 | Kim | G09G 3/3233 345/82 |
| 2016/0189595 | A1 | 6/2016 | Choi et al. | |
| 2019/0371242 | A1 | 12/2019 | Chaji | |
| 2020/0043435 | A1 | 2/2020 | Kim | |

FOREIGN PATENT DOCUMENTS

| | | | |
|---|---|---|---|
| CN | 101582248 | A | 11/2009 |
| CN | 101594118 | A | 12/2009 |
| CN | 102157126 | A | 8/2011 |
| CN | 104050926 | A | 9/2014 |
| CN | 104282271 | A | 1/2015 |
| CN | 104318883 | A | 1/2015 |
| CN | 108039149 | A | 5/2018 |
| CN | 108701436 | A | 10/2018 |
| CN | 108962156 | A | 12/2018 |
| CN | 110689856 | A | 1/2020 |
| CN | 112289270 | A | 1/2021 |

OTHER PUBLICATIONS

Chinese Office Action dated Feb. 5, 2021, in connection with Chinese Application No. 202011572901.X.

* cited by examiner

SOURCE DRIVING CIRCUIT, DISPLAY DEVICE, AND PIXEL DRIVING METHOD

CROSS-REFERENCES TO RELATED APPLICATIONS

This is a National Stage Application, filed under 35 U.S.C. § 371, of International Patent Application No. PCT/CN2021/083263, filed on Mar. 26, 2021, which is based on and claims priority to Chinese Patent Application No. 202011572901.X, filed with the China National Intellectual Property Administration (CNIPA) on Dec. 28, 2020, each of which is incorporated herein by reference in their entirety.

TECHNICAL FIELD

The present application relates to the field of display technologies, for example, a source driving circuit, a display device and a pixel driving method.

BACKGROUND

The light-emitting element of an organic light-emitting display device is an organic light-emitting diode, and the organic light-emitting diode is a self-emitting current-type light-emitting element and driven by a drive transistor in a pixel driving circuit to emit light. The magnitude of a drive current flowing through the organic light-emitting element is correlated with the threshold voltage Vth of the drive transistor. In order to avoid the problem that drift of the threshold voltages Vth causes differences in the magnitudes of the currents flowing through the organic light-emitting elements, the threshold voltages Vth are usually compensated during a driving process.

At present, the compensation method of the threshold voltage Vth includes internal compensation and external compensation. The internal compensation achieves the compensation for the threshold voltage Vth in a manner of adding a thin-film transistor and a corresponding signal line into the pixel driving circuit. The external compensation achieves the compensation for the threshold voltage Vth in a manner of setting a compensation circuit in a non-display region by means of global compensation. However, when the internal compensation method is applied, the space occupied by the pixel driving circuit may be increased, the area of the display device may be increased, and the resolution of the display device may be reduced.

SUMMARY

The present application provides a source driving circuit, a display device and a pixel driving method, so as to achieve the external compensations for the threshold voltages of drive transistors in pixel driving circuits, and improve the uniformities of the pixel driving circuits in a display panel.

In a first aspect, embodiments of the present application provide a source driving circuit.

The source driving circuit includes a voltage isolation circuit, a voltage follower circuit, a first voltage dividing circuit, a second voltage dividing circuit, a first switch circuit, a second switch circuit, a third switch circuit, a fourth switch circuit, a fifth switch circuit, a sixth switch circuit and a current source.

The voltage isolation circuit is electrically connected between a first node and a second node and is configured to isolate a voltage of the first node from a voltage of the second node.

A first terminal of the voltage follower circuit is electrically connected to the second node, a second terminal of the voltage follower circuit is electrically connected to a third node, and a third terminal of the voltage follower circuit is electrically connected to a fourth node; and the voltage follower circuit is configured to set a voltage of the third node to be varied with the voltage of the second node in a data write stage.

The first voltage dividing circuit is electrically connected between the third node and a positive power supply signal terminal, and the first voltage dividing circuit is configured to adjust the voltage of the third node. The second voltage dividing circuit is electrically connected between the fourth node and a negative power supply signal terminal, and the second voltage dividing circuit is configured to adjust a voltage of the fourth node.

The first switch circuit is electrically connected between the second node and the fourth node, and the first switch circuit is configured to form a conductive pathway between the second node and the fourth node in a reset and initialization stage. The second switch circuit is electrically connected between the fourth node and the negative power supply signal terminal, and the second switch circuit is configured to form a conductive pathway between the fourth node and the negative power supply signal terminal in the data write stage. The third switch circuit is electrically connected between a fifth node and the positive power supply signal terminal, the fifth node and the first node are electrically connected to a pixel driving circuit, and the third switch circuit is configured to form a conductive pathway between the fifth node and the positive power supply signal terminal in the reset and initialization stage. The fourth switch circuit is electrically connected between the third node and the fifth node, and the fourth switch circuit is configured to form a conductive pathway between the third node and the fifth node in the data write stage. The fifth switch circuit is electrically connected between the first node and a reset signal terminal, and the fifth switch circuit is configured to form a conductive pathway between the first node and the reset signal terminal in the reset and initialization stage. The sixth switch circuit is electrically connected between the first node and the current source, and the sixth switch circuit is configured to form a conductive pathway between the first node and the current source in the data write stage.

The current source is electrically connected between the sixth switch circuit and the negative power supply signal terminal and is configured to provide a data current.

In a second aspect, the embodiments of the present application further provide a display device. The display device includes a source driving circuit group and a pixel driving circuit group, where the source driving circuit group includes a plurality of source driving circuits described in the first aspect, and the pixel driving circuit group includes a plurality of pixel driving circuits. Each of the plurality of source driving circuits is electrically connected to at least one of the plurality of pixel driving circuits.

Each of the plurality of pixel driving circuits includes a drive transistor, a seventh switch circuit, an eighth switch circuit, a ninth switch circuit and an electricity storage circuit.

The seventh switch circuit is electrically connected between a gate of the drive transistor and a fifth node in a corresponding source driving circuit, and the seventh switch circuit is configured to form a conductive pathway between the gate of the drive transistor and the fifth node in the corresponding source driving circuit in a reset and initialization stage and a data write stage.

The eighth switch circuit is electrically connected between a drain of the drive transistor and a first node in the corresponding source driving circuit, and the eighth switch circuit is configured to form a conductive pathway between the drain of the drive transistor and the first node in the corresponding source driving circuit in the reset and initialization stage and the data write stage. The ninth switch circuit is electrically connected between the drain of the drive transistor and an anode of a light-emitting diode, and the ninth switch circuit is configured to form a conductive pathway between the drain of the drive transistor and the anode of the light-emitting diode in the reset and initialization stage and a light emission stage.

The electricity storage circuit is electrically connected between the gate of the drive transistor and a first voltage signal terminal, and the electricity storage circuit is configured to adjust a gate voltage of the drive transistor.

A source of the drive transistor is electrically connected to a positive power supply signal terminal; and the drive transistor is configured to drive the light-emitting diode to emit light in the light emission stage.

In a third aspect, the embodiments of the present application further provide a pixel driving method, the pixel driving method being applied to the display device described in the second aspect and including steps described below.

In a reset and initialization stage, a first switch circuit, a third switch circuit, a fifth switch circuit, a seventh switch circuit, an eighth switch circuit and a ninth switch circuit are turned on to establish initial voltages of a first node, a second node, a third node, a fourth node and a fifth node in each source driving circuit. A drive transistor in a pixel driving circuit is reset, and an output voltage of a first voltage signal output terminal is adjusted to be a preset initial voltage.

In a data write stage, the first switch circuit, the third switch circuit and the fifth switch circuit are turned off and a second switch circuit, a fourth switch circuit and a sixth switch circuit are turned on to establish a loop formed by the drive transistor, the seventh switch circuit, the eighth switch circuit, a voltage isolation circuit and a voltage follower circuit. Where a current in the loop is equal to a current output from a current source, and an electricity storage circuit is charged.

In a light emission stage, the seventh switch circuit and the eighth switch circuit are turned off, the output voltage of the first voltage signal output terminal is adjusted according to a preset requirement, and the ninth switch circuit is turned on, where the drive transistor, the ninth switch circuit and a light-emitting diode form a current path, the electricity storage circuit maintains a gate voltage of the drive transistor unchanged, and a drive current of the drive transistor drives the light-emitting diode to emit light.

In the source driving circuit provided by the embodiments of the present application, the voltage isolation circuit is electrically connected between the first node and the second node, the first terminal of the voltage follower circuit is electrically connected to the second node, the second terminal of the voltage follower circuit is electrically connected to the third node, the third terminal of the voltage follower circuit is electrically connected to the fourth node. The first voltage dividing circuit is electrically connected between the third node and the positive power supply signal terminal, and the second voltage dividing circuit is electrically connected between the fourth node and the negative power supply signal terminal. The first switch circuit is electrically connected between the second node and the fourth node, the second switch circuit is electrically connected between the fourth node and the negative power supply signal terminal, the third switch circuit is electrically connected between the fifth node and the positive power supply signal terminal, the fifth node and the first node are electrically connected to the pixel driving circuit, the fourth switch circuit is electrically connected between the third node and the fifth node, the fifth switch circuit is electrically connected between the first node and the reset signal terminal, the sixth switch circuit is electrically connected between the first node and the current source, and the current source is electrically connected between the sixth switch circuit and the negative power supply signal terminal. In this way, a loop can be formed by the source driving circuit and the drive transistor in the pixel driving circuit, and the drive current flowing through the drive transistor is equal to the data current of the current source, so that the external compensations for the threshold voltage drifts of the drive transistors are achieved, and the uniformities of the pixel driving circuits in the display device are improved.

DETAILED DESCRIPTION

Figure 1:
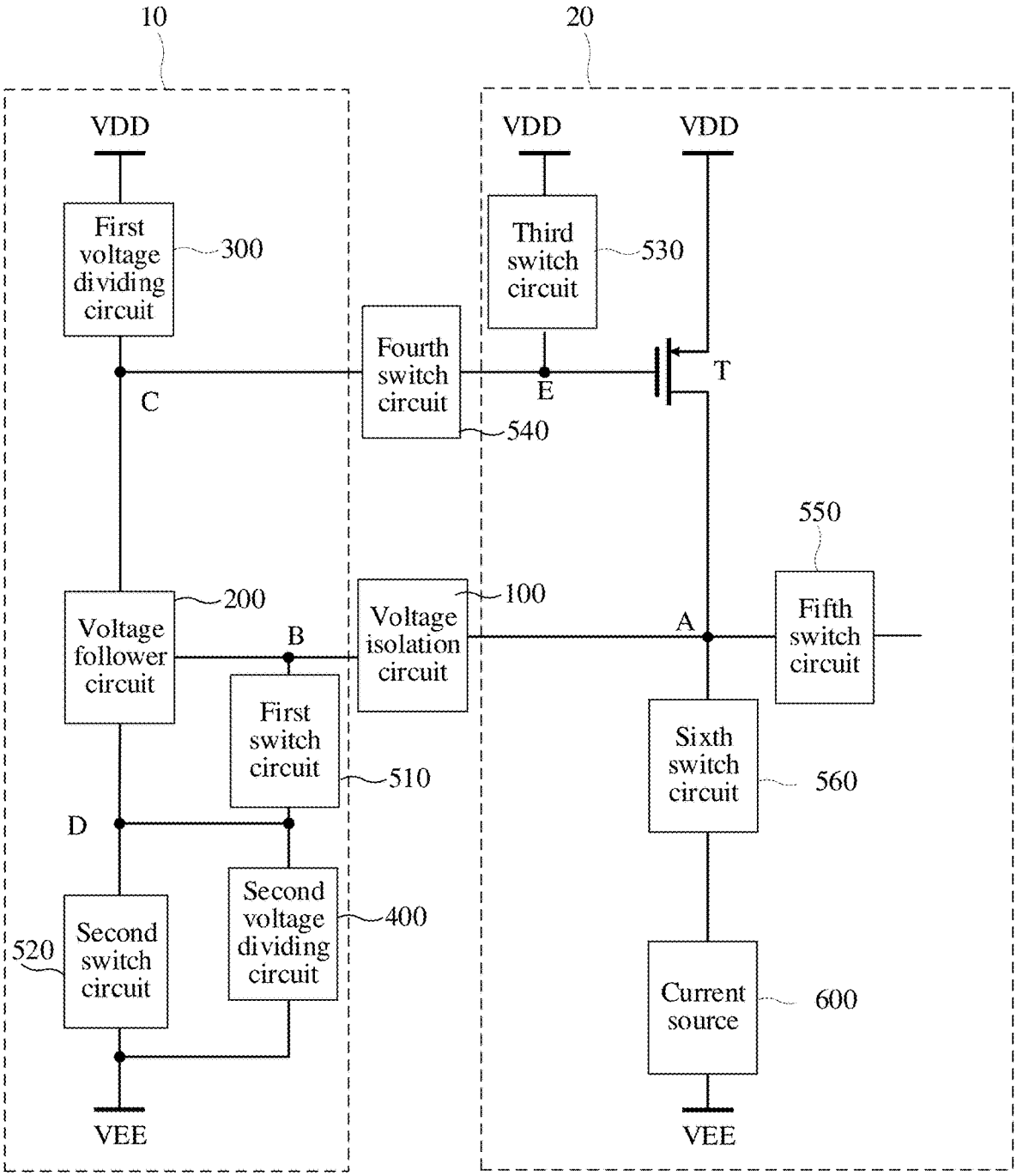
FIG. 1 is a structural diagram of a source driving circuit according to an embodiment of the present application.

Embodiments of the present application provide a source driving circuit.

The source driving circuit includes a voltage isolation circuit, a voltage follower circuit, a first voltage dividing circuit, a second voltage dividing circuit, a first switch circuit, a second switch circuit, a third switch circuit, a fourth switch circuit, a fifth switch circuit, a sixth switch circuit and a current source.

The voltage isolation circuit is electrically connected between a first node and a second node, and the voltage isolation circuit is configured to isolate a voltage of the first node from a voltage of the second node.

A first terminal of the voltage follower circuit is electrically connected to the second node, a second terminal of the voltage follower circuit is electrically connected to a third node, and a third terminal of the voltage follower circuit is electrically connected to a fourth node. The voltage follower circuit is configured to set a voltage of the third node to be varied with the voltage of the second node in a data write stage.

The first voltage dividing circuit is electrically connected between the third node and a positive power supply signal terminal, and the first voltage dividing circuit is configured to adjust the voltage of the third node. The second voltage dividing circuit is electrically connected between the fourth node and a negative power supply signal terminal, and the second voltage dividing circuit is configured to adjust a voltage of the fourth node.

The first switch circuit is electrically connected between the second node and the fourth node, and the first switch circuit is configured to form a conductive pathway between the second node and the fourth node in a reset and initialization stage. The second switch circuit is electrically connected between the fourth node and the negative power supply signal terminal, and the second switch circuit is configured to form a conductive pathway between the fourth node and the negative power supply signal terminal in the data write stage. The third switch circuit is electrically connected between a fifth node and the positive power supply signal terminal, and the fifth node and the first node are electrically connected to a pixel driving circuit, and the third switch circuit is configured to form a conductive pathway between the fifth node and the positive power supply signal terminal in the reset and initialization stage. The fourth switch circuit is electrically connected between the third node and the fifth node, and the fourth switch circuit is configured to form a conductive pathway between the third node and the fifth node in the data write stage. The fifth switch circuit is electrically connected between the first node and a reset signal terminal, and the fifth switch circuit is configured to form a conductive pathway between the first node and the reset signal terminal in the reset and initialization stage. The sixth switch circuit is electrically connected between the first node and the current source, and the sixth switch circuit is configured to form a conductive pathway between the first node and the current source in the data write stage.

The current source is electrically connected between the sixth switch circuit and the negative power supply signal terminal, and the current source is configured to provide a data current.

In the source driving circuit provided by the embodiments of the present application, the voltage isolation circuit is electrically connected between the first node and the second node, the first terminal of the voltage follower circuit is electrically connected to the second node, the second terminal of the voltage follower circuit is electrically connected to the third node, the third terminal of the voltage follower circuit is electrically connected to the fourth node. The first voltage dividing circuit is electrically connected between the third node and the positive power supply signal terminal, and the second voltage dividing circuit is electrically connected between the fourth node and the negative power supply signal terminal. The first switch circuit is electrically connected between the second node and the fourth node, the second switch circuit is electrically connected between the fourth node and the negative power supply signal terminal, the third switch circuit is electrically connected between the fifth node and the positive power supply signal terminal, and the fifth node and the first node are electrically connected to the pixel driving circuit. The fourth switch circuit is electrically connected between the third node and the fifth node, the fifth switch circuit is electrically connected between the first node and the reset signal terminal, the sixth switch circuit is electrically connected between the first node and the current source, and the current source is electrically connected between the sixth switch circuit and the negative power supply signal terminal. In this way, a loop can be formed by the source driving circuit and the drive transistor in the pixel driving circuit, and the drive current flowing through the drive transistor is equal to the data current of the current source, so that the external compensations for the threshold voltage drifts of the drive transistors are achieved, and the uniformities of the pixel driving circuits in the display device are improved.

The above is the core idea of the present application. Hereinafter, technical solutions in the embodiments of the present application will be described clearly and completely in conjunction with drawings in the embodiments of the present application. Apparently, the embodiments described below are part, not all, of the embodiments of the present application. Based on the embodiments of the present application, all other embodiments obtained by those of ordinary skill in the art without creative work are within the scope of the present application.

Details are set forth below to facilitate a thorough understanding of the present application. However, the present application may be implemented by other embodiments different from the embodiments described herein, and those skilled in the art may make similar generalizations without departing from the spirit of the present application. Therefore, the present application is not limited to the specific embodiments described below.

In addition, the present application is described in detail in conjunction with the drawings. In detailed description of the embodiments of the present application, for ease of description, schematic diagrams illustrating structures of devices and components are not partially enlarged in accordance with a general scale. The schematic diagrams are merely illustrative and are not intended to limit the scope of the present application. In addition, actual manufacturing should include three-dimension spatial sizes: the length, the width and the height.

FIG. 1 is a structural diagram of a source driving circuit according to an embodiment of the present application. As shown in FIG. 1, the source driving circuit includes a voltage isolation circuit 100, a voltage follower circuit 200, a first voltage dividing circuit 300, a second voltage dividing circuit 400, a first switch circuit 510, a second switch circuit 520, a third switch circuit 530, a fourth switch circuit 540, a fifth switch circuit 550, a sixth switch circuit 560 and a current source 600.

The voltage isolation circuit 100 is electrically connected between a first node A and a second node B and is configured to isolate a voltage of the first node A from a voltage of the second node B. A first terminal of the voltage follower circuit 200 is electrically connected to the second node B, a second terminal of the voltage follower circuit 200 is electrically connected to a third node C, and a third terminal of the voltage follower circuit 200 is electrically connected to a fourth node D. The voltage follower circuit 200 is configured to set a voltage of the third node C to be varied with the voltage of the second node B in a data write stage. The first voltage dividing circuit 300 is electrically connected between the third node C and a positive power supply signal terminal VDD, and the first voltage dividing circuit 300 is configured to adjust the voltage of the third node C. The second voltage dividing circuit 400 is electrically connected between the fourth node D and a negative power supply signal terminal VEE, and the second voltage dividing circuit 400 is configured to adjust a voltage of the fourth node D. The first switch circuit 510 is electrically connected between the second node B and the fourth node D and the first switch circuit 510 is configured to form a conductive pathway between the second node B and the fourth node D in a reset and initialization stage. The second switch circuit 520 is electrically connected between the fourth node D and the negative power supply signal terminal VEE, and the second switch circuit 520 is configured to form a conductive pathway between the fourth node D and the negative power supply signal terminal VEE in the data write stage. The third switch circuit 530 is electrically connected between a fifth node E and the positive power supply signal terminal VDD, and the fifth node E and the first node A are electrically connected to a drive transistor T of a pixel driving circuit. The third switch circuit 530 is configured to form a conductive pathway between the fifth node E and the positive power supply signal terminal VDD in the reset and initialization stage. The fourth switch circuit 540 is electrically connected between the third node C and the fifth node E, and the fourth switch circuit 540 is configured to form a conductive pathway between the third node C and the fifth node E in the data write stage. The fifth switch circuit 550 is electrically connected between the first node A and a reset signal terminal VRST, and the fifth switch circuit 550 is configured to form a conductive pathway between the first node A and the reset signal terminal VRST in the reset and initialization stage. The sixth switch circuit 560 is electrically connected between the first node A and the current source 600, and the sixth switch circuit 560 is configured to form a conductive pathway between the first node A and the current source 600 in the data write stage. The current source 600 is electrically connected between the sixth switch circuit 560 and the negative power supply signal terminal VEE, and the current source 600 is configured to provide a data current.

It is to be noted that to more clearly show the electrical connection relationship between the source driving circuit and the pixel driving circuit provided by the embodiment, the drive transistor T of the pixel driving circuit is illustrated in FIG. 1, but the drive transistor T does not belong to the source driving circuit.

It should be noted that due to process reasons, drive transistors in pixel driving circuits configured at different positions may have inconsistent threshold voltages, which may result in inconsistent currents supplied to light-emitting elements when the same direct current gate bias is applied to the drive transistors, so that it is necessary to compensate for the threshold voltage drift of the drive transistors to improve the uniformity of the currents supplied to the light-emitting elements by the pixel driving circuits. Facing with the above problem, the source driving circuit provided by the embodiment enables the drive transistor T to provide consistent light emission currents to the light-emitting elements, so that the effective threshold compensation of the drive transistor T is achieved.

Specifically, in the reset and initialization stage, the first switch circuit 510, the third switch circuit 530 and the fifth switch circuit 550 are turned on, the second switch circuit 520, the fourth switch circuit 540 and the sixth switch circuit 560 are turned off, the voltage isolation circuit 100 isolates the voltage of the first node A from the voltage of the second node B, and the source driving circuit may be divided into a first branch 10 and a second branch 20 without a direct electrical connection.

At this time, the voltage VA of the first node A satisfies that VA=VRST; a voltage VE of the fifth node E satisfies that VE=VDD; the voltage VB of the second node B and the voltage VD of the fourth node D satisfy that VB=VD=VEE+V2, where V2 denotes a voltage of the second voltage dividing circuit 400; and the voltage VC of the third node C satisfies that VC=VDD−V1, where V1 denotes a voltage of the first voltage dividing circuit 300. For the drive transistor T of the pixel driving circuit, a gate voltage and source voltage of the drive transistor T are both VDD, that is, the gate-source voltage VGS satisfies that VGS=0, so that no current flows through the drive transistor T.

In the data write stage, the first switch circuit 510, the third switch circuit 530 and the fifth switch circuit 550 are turned off, and the second switch circuit 520, the fourth switch circuit 540 and the sixth switch circuit 560 are turned on. Since no current flows through the drive transistor T of the pixel driving circuit in the reset and initialization stage, in the data write stage, no pull-up effect exists in the potential at the drive transistor T side of the first node A. At the current source 600 side of the first node A, the sixth switch circuit 560 is turned on, and a potential pull-down effect of the current source 600 exists, and then after the data write stage starts, the voltage of the first node A decreases.

The first node A and the second node B are respectively located on two sides of the voltage isolation circuit 100, the voltage of the first node A decreases, and the voltage of the second node B decreases accordingly. The voltage of the third node C decreases with the voltage of the second node B under the action of the voltage follower circuit 200, the fifth node E is electrically connected to the third node C via the fourth switch circuit 540, and a voltage of the fifth node E decreases as the voltage of the third node C decreases. As a result, the gate voltage of the drive transistor T electrically connected to the fifth node E decreases, and the gate-source voltage VGS of the drive transistor satisfies that VGS<0. A current flows through the drive transistor T, and the current gradually increases until the current is equal to the data current output from the current source 600. Therefore, a loop formed by the source driving circuit and the pixel driving circuit is formally established, the current flowing through the drive transistor T is independent of the threshold voltage of the drive transistor T, and thus the threshold compensation of the drive transistor T is achieved.

Figure 2:
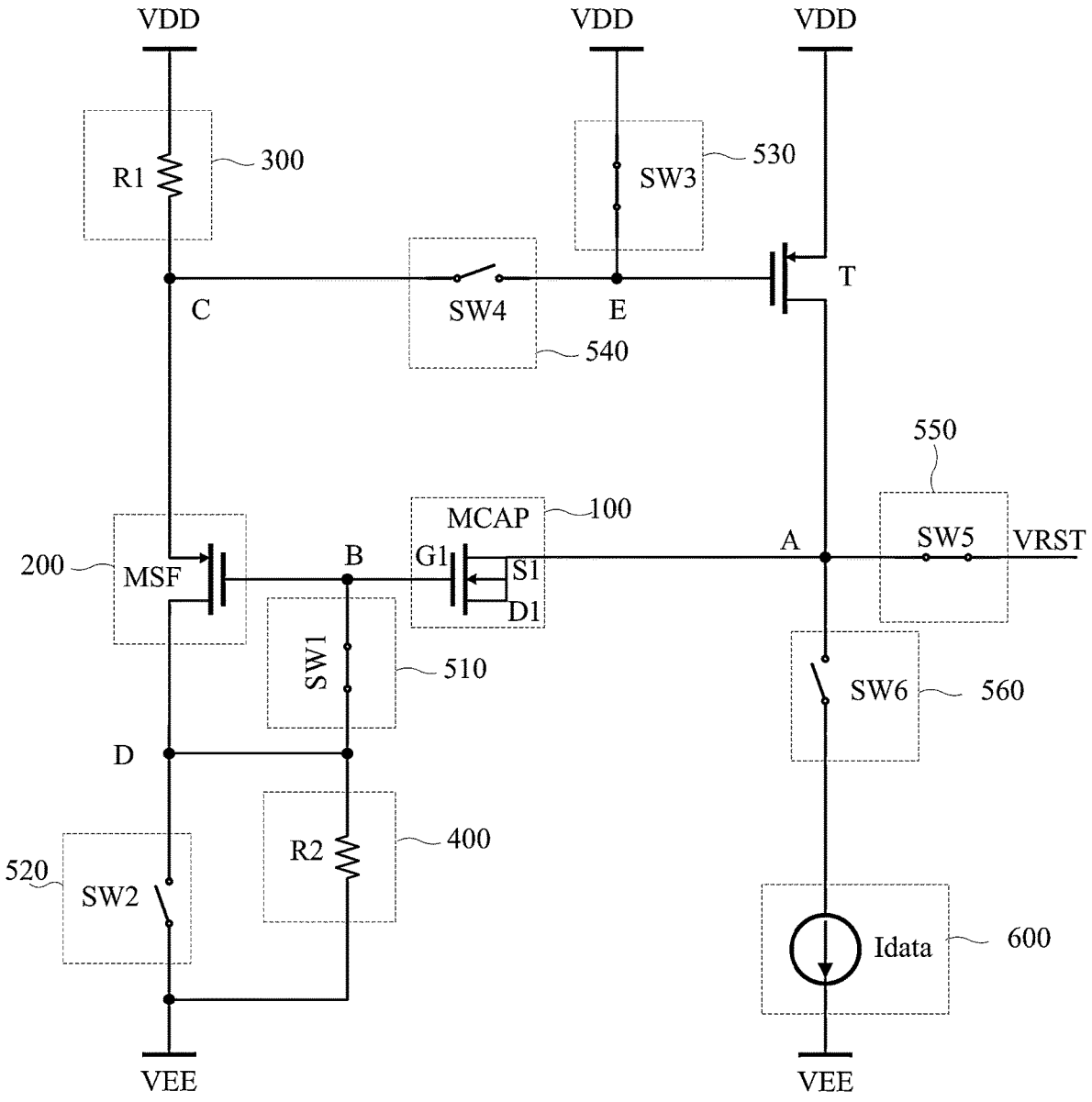
FIG. 2 is a structural diagram of another source driving circuit according to an embodiment of the present application.

In the source driving circuit provided by the embodiment, the voltage isolation circuit is electrically connected between the first node and the second node, the first terminal of the voltage follower circuit is electrically connected to the second node, the second terminal of the voltage follower circuit is electrically connected to the third node, the third terminal of the voltage follower circuit is electrically connected to the fourth node. The first voltage dividing circuit is electrically connected between the third node and the positive power supply signal terminal, and the second voltage dividing circuit is electrically connected between the fourth node and the negative power supply signal terminal. The first switch circuit is electrically connected between the second node and the fourth node, the second switch circuit is electrically connected between the fourth node and the negative power supply signal terminal, the third switch circuit is electrically connected between the fifth node and the positive power supply signal terminal, and the fifth node and the first node are electrically connected to the pixel driving circuit. The fourth switch circuit is electrically connected between the third node and the fifth node, the fifth switch circuit is electrically connected between the first node and the reset signal terminal, the sixth switch circuit is electrically connected between the first node and the current source, and the current source is electrically connected between the sixth switch circuit and the negative power supply signal terminal. In this way, a loop can be formed by the source driving circuit and the drive transistor in the pixel driving circuit, and the drive current flowing through the drive transistor is equal to the data current of the current source, so that the external compensations for the threshold voltage drifts of the drive transistors are achieved, and the uniformities of the pixel driving circuits in the display device are improved FIG. 2 is a structural diagram of another source driving circuit according to an embodiment of the present application. Optionally, as shown in FIG. 2, the voltage isolation circuit 100 may be a capacitor MCAP.

It should be noted that the capacitor is a single element having a good voltage isolation effect and a simple structure, and the cost of the capacitor is low. Thus, the capacitor is an alternative structure of the voltage isolation circuit 100. It is to be understood that only the capacitor is used as an example for illustration and not limitation, the voltage isolation circuit 100 may be other structures in other implementations of the embodiment, and any structure capable of implementing the voltage isolation is within the scope of the embodiment.

Exemplarily, referring to FIG. 2, the capacitor MCAP may be a transistor capacitor. The transistor capacitor includes a gate portion G1, a source portion S1 and a drain portion D1, the source portion S1 and the drain portion D1 electrically connected to each other are used as a first electrode of the capacitor MCAP, and the gate portion G1 is used as a second electrode of the capacitor MCAP.

It should be noted that main elements in functional circuits of a display device are transistors, for example, main elements of a gate driver circuit and a pixel driving circuit are transistors. Based on this, the preparation process of transistors is the most mature and stable among preparation processes of the functional circuits of the display device. In the embodiment, in the preparation process of original transistors in the functional circuits of the display device, the gate portion, the source portion and the drain portion of the transistor capacitor are formed simultaneously, and then the transistor capacitor is formed through electrode interconnection. In this way, it is not necessary to specially set the preparation process and parameters of the transistor capacitor, which is beneficial to reducing the difficulty of the preparation process of the source driving circuit.

As shown in FIG. 2, optionally, the voltage follower circuit 200 may be a first transistor MSF, a gate of the first transistor MSF is electrically connected to the second node B, a source of the first transistor MSF is electrically connected to the third node C, and a drain of the first transistor MSF is electrically connected to the fourth node D.

Specifically, referring to FIG. 1, in the reset and initialization stage, the first branch 10 satisfies that VDD–VEE=V1+V2+V3, where V1 denotes the voltage of the first voltage dividing circuit 300, V2 denotes a voltage of the voltage follower circuit 200, and V3 denotes the voltage of the second voltage dividing circuit 400. More specifically, when the voltage follower circuit 200 is the first transistor MSF, according to a formula for calculating a current of the transistor and satisfying that $$I = \frac{1}{2}\mu C_{ox}\frac{W}{L}(V_{sg} - |V_{th}|)^2,$$

V2 satisfying that $$V2 = V_{sg} = \left[\sqrt{\frac{2*I}{\mu p * C_{ox} * \frac{W}{L}}} + V_{th}\right]$$

can be obtained.

In the data write stage, the second switch circuit 520 is turned on, and the drain of the first transistor MSF is connected to the negative power supply signal terminal VEE. The first transistor MSF is used as a source follower, a source voltage of the first transistor MSF varies with a gate voltage of the first transistor MSF, and then the voltage of the third node C electrically connected to the source of the first transistor MSF varies with the voltage of the second node B connected to the gate of the first transistor MSF.

It should be noted that when an appropriate electrode connection manner is adopted, a voltage follower effect can be achieved since the transistor has the function of the source follower.

With continued reference to FIG. 2, the first voltage dividing circuit 300 and the second voltage dividing circuit 400 may both be resistors.

Specifically, referring to FIG. 1, during the reset and initialization stage, the first branch 10 satisfies that VDD–VEE=V1+V2+V3, where V1 denotes the voltage of the first voltage dividing circuit 300, V2 denotes the voltage of the voltage follower circuit 200, and V3 denotes the voltage of the second voltage dividing circuit 400. More specifically, when the first voltage dividing circuit 300 and the second voltage dividing circuit 400 are both resistors, the voltage V1 of the first voltage dividing circuit 300 satisfies that V1=I×R1, and the voltage V3 of the second voltage dividing circuit satisfies that V3=I×R2, where R1 is resistance of the first voltage dividing circuit 300, R2 is resistance of the second voltage dividing circuit 400, and I is a current in the first branch 10.

Further, as shown in FIG. 2, the case where the first voltage dividing circuit 300 and the second voltage dividing circuit 400 are both resistors and the voltage follower circuit 200 is the first transistor MSF satisfies that $$VDD - VEE = I \times R1 + \left[\sqrt{\frac{2*I}{\mu p * C_{ox} * \frac{W}{L}}} + V_{th}\right] + I \times R2,$$

where only I is an unknown variable. Therefore, the current I in the first branch 10 may be obtained by calculating performing calculation according to the above formula, and voltages of the second node B, the fourth node D and the third node C, that is, initial voltages of the second node B, the fourth node D and the third node C, can be further obtained.

Figure 3:
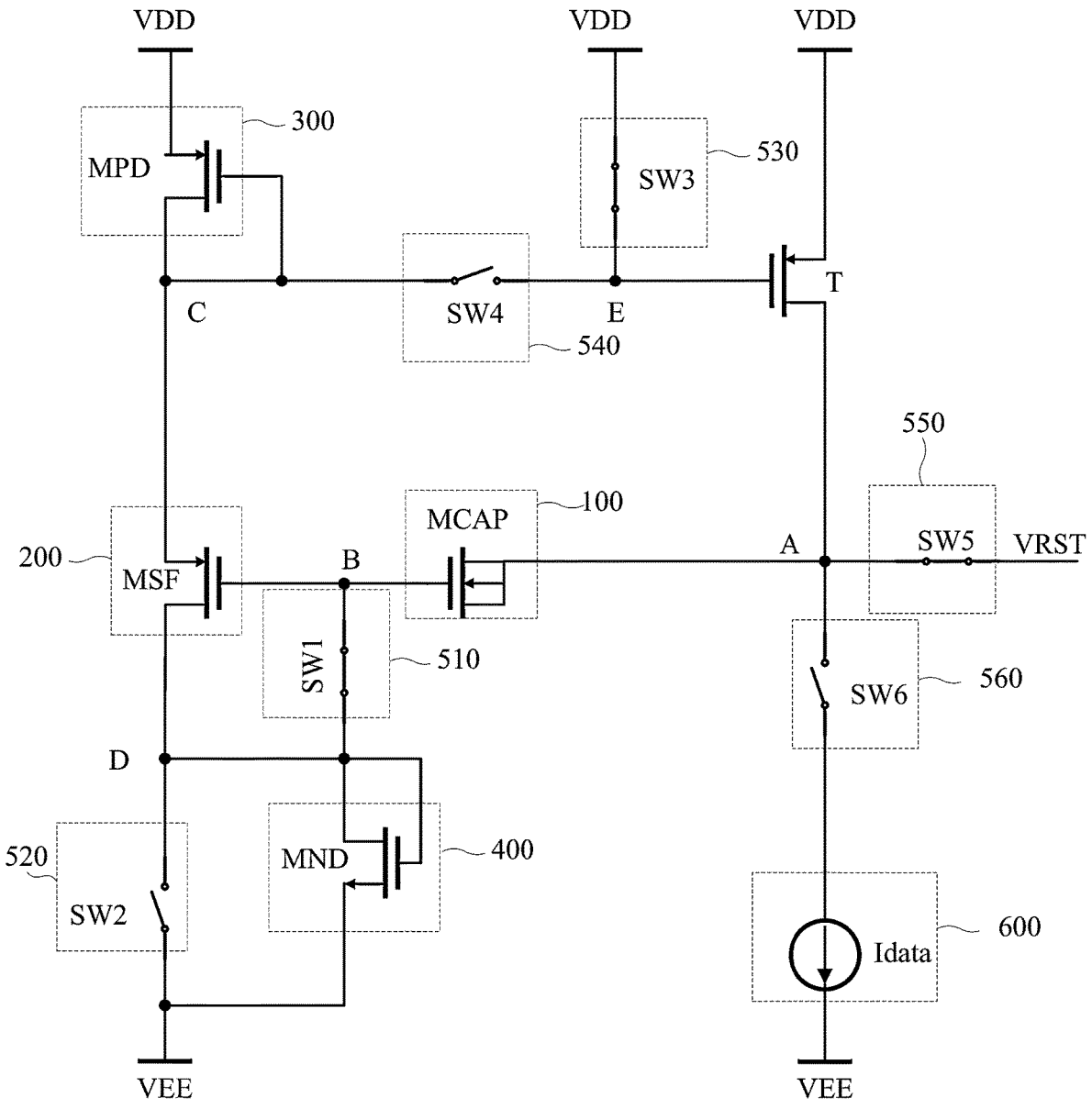
FIG. 3 is a structural diagram of another source driving circuit according to an embodiment of the present application.

It is to be understood that in other implementations of the embodiment, the first voltage dividing circuit 300 and the second voltage dividing circuit 400 may both be transistors, as shown in FIG. 3.

Specifically, referring to FIG. 3, the first voltage dividing circuit 300 and the second voltage dividing circuit 400 are both transistors, the first voltage dividing circuit 300 is a P-type second transistor MPD, and the second voltage dividing circuit 400 is an N-type third transistor MND. A gate and a drain of the P-type second transistor MPD are both electrically connected to the third node C, and a source of the P-type second transistor MPD is electrically connected to the positive power supply signal terminal VDD. A gate and a drain of the N-type third transistor MND are both electrically connected to the fourth node D, and a source of the N-type third transistor MND is electrically connected to the negative power supply signal terminal VEE.

It is to be understood that the type of the second transistor MPD and the type of the third transistor MND are not limited to the types shown in FIG. 3, and the type of the second transistor MPD and the type of the third transistor MND are not limited insofar as the voltage dividing function of the second transistor MPD and the third transistor MND can be implemented.

It should be noted that in other implementations of the embodiment, the first voltage dividing circuit 300 and the second voltage dividing circuit 400 may also be other types of loads, for example, current source loads which may vary with the gray scale. All load forms that can perform the voltage dividing function are within the scope of the embodiment.

In the embodiment, the first switch circuit 510, the second switch circuit 520, the third switch circuit 530, the fourth switch circuit 540, the fifth switch circuit 550 and the sixth switch circuit 560 may be any structure having the switch function, and exemplarily, the first switch circuit 510, the second switch circuit 520, the third switch circuit 530, the fourth switch circuit 540, the fifth switch circuit 550 and the sixth switch circuit 560 may all be conventional switches, as shown in FIGS. 2 and 3.

Figure 4:
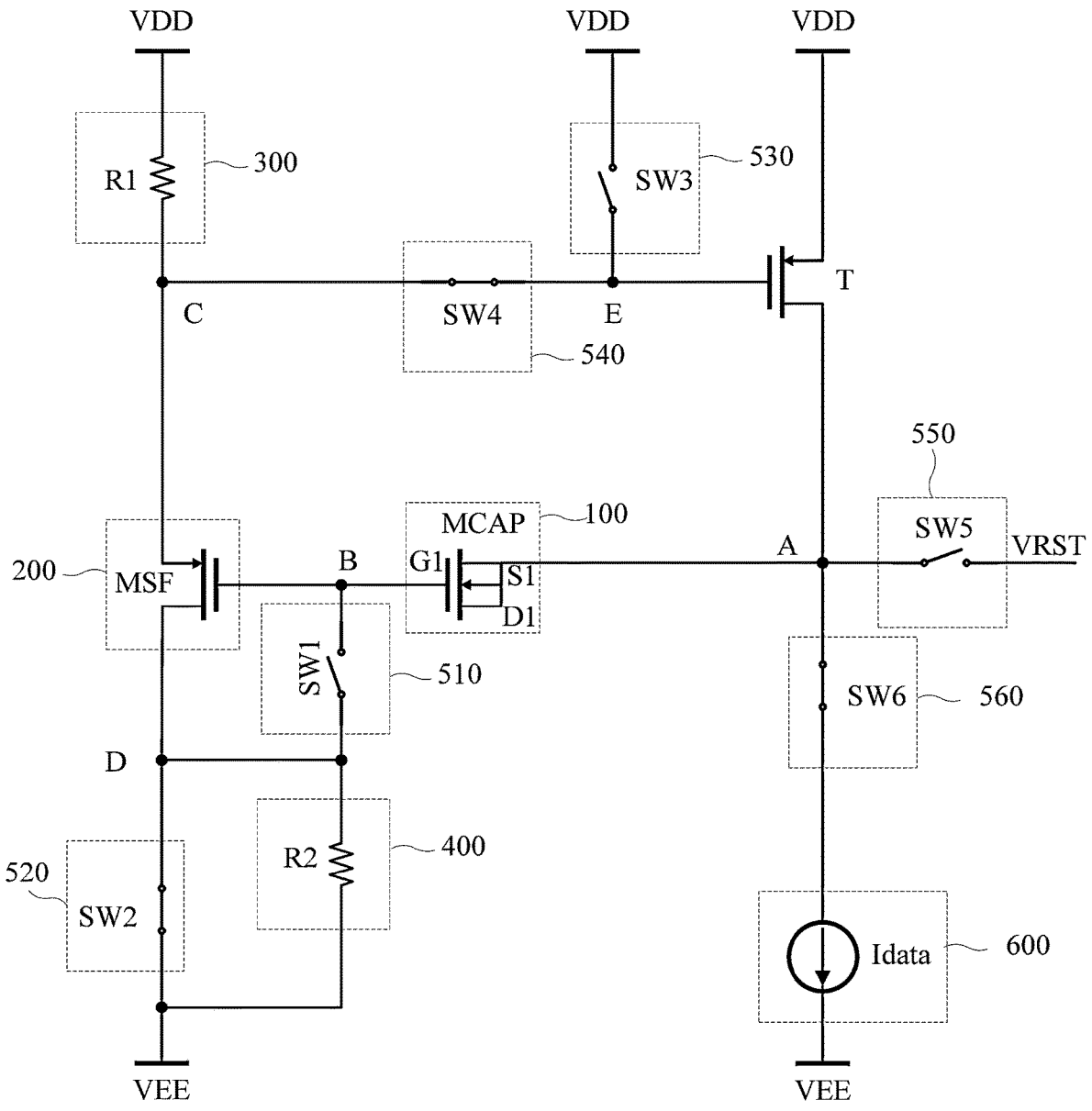
FIG. 4 is a structural diagram of another source driving circuit according to an embodiment of the present application.
Figure 5:
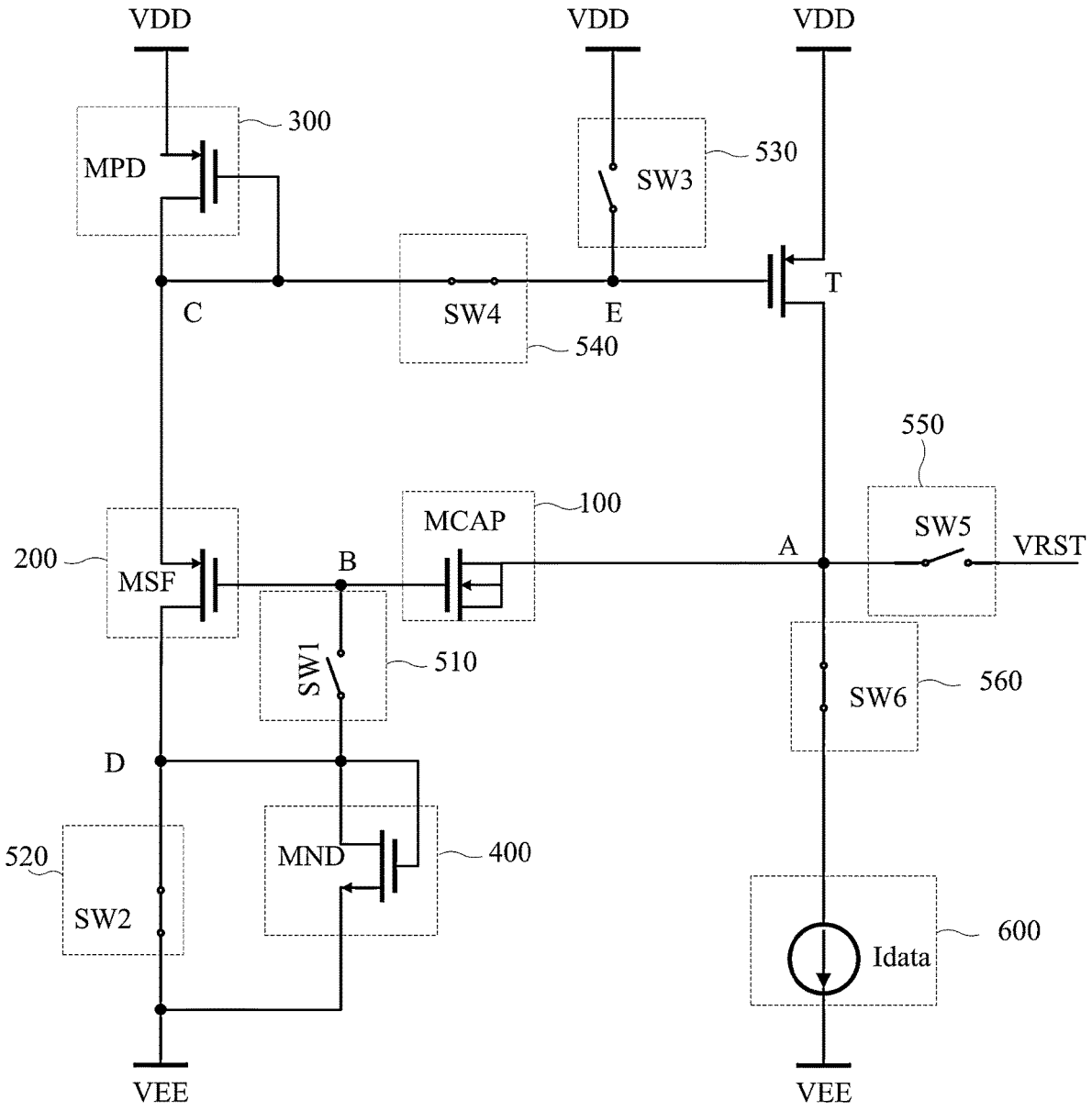
FIG. 5 is a structural diagram of another source driving circuit according to an embodiment of the present application.

Specifically, referring to FIGS. 2 and 3, the first switch circuit 510 is a first switch SW1, the second switch circuit 520 is a second switch SW2, the third switch circuit 530 is a third switch SW3, the fourth switch circuit 540 is a fourth switch SW4, the fifth switch circuit 550 is a fifth switch SW5, and the sixth switch circuit 560 is a sixth switch SW6. In the reset and initialization stage, the first switch SW1, the third switch SW3 and the fifth switch SW5 are turned on, and the second switch SW2, the fourth switch SW4 and the sixth switch SW6 are turned off, as shown in FIGS. 2 and 3. In the data write stage, the first switch SW1, the third switch SW3 and the fifth switch SW5 are turned off, and the second switch SW2, the fourth switch SW4 and the sixth switch SW6 are turned on, as shown in FIGS. 4 and 5.

Figure 6:
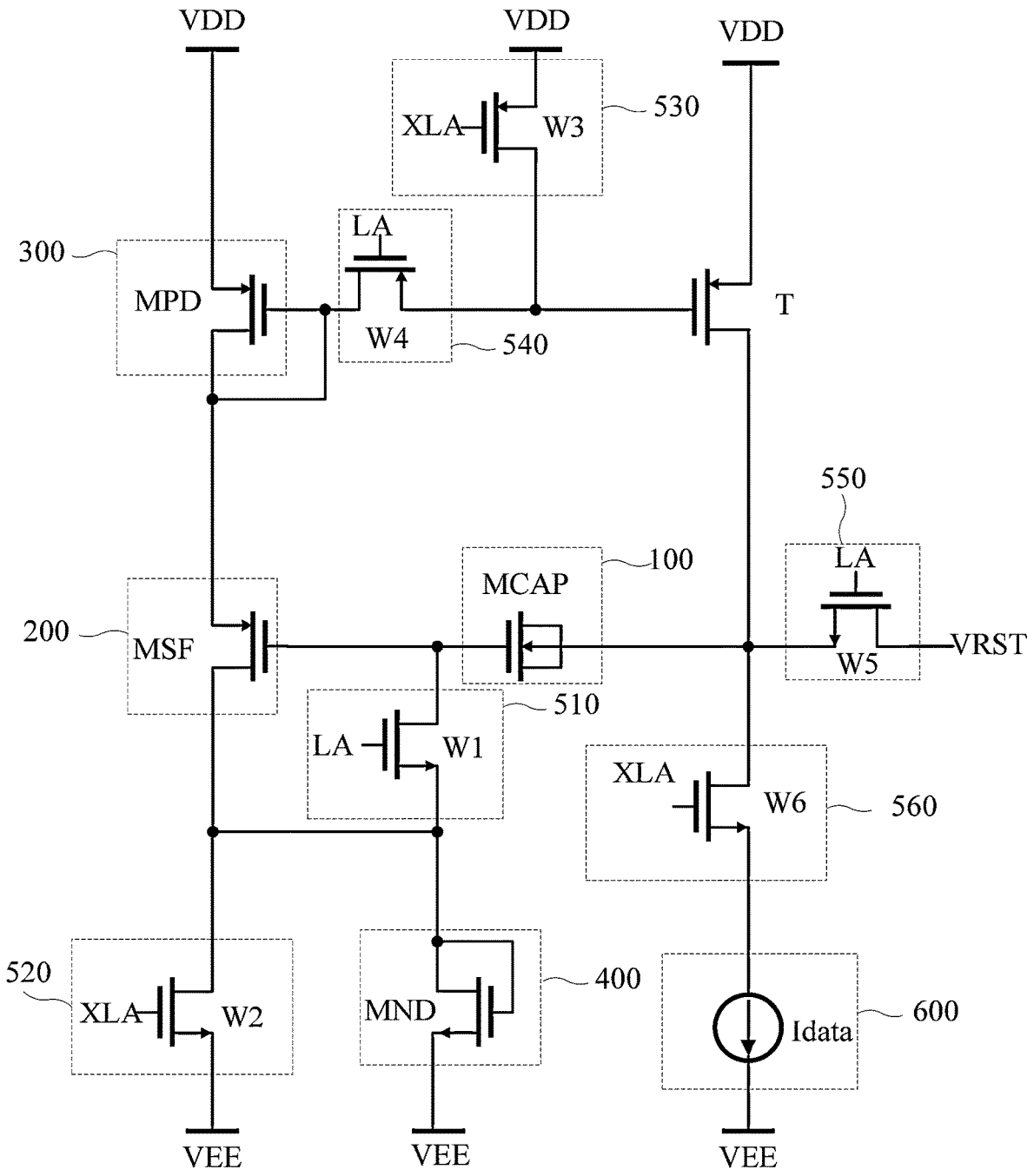
FIG. 6 is a structural diagram of another source driving circuit according to an embodiment of the present application.

In other implementations of the embodiment, the first switch circuit 510, the second switch circuit 520, the third switch circuit 530, the fourth switch circuit 540, the fifth switch circuit 550 and the sixth switch circuit 560 may also all be transistors. Specifically, FIG. 6 is a structural diagram of another source driving circuit according to an embodiment of the present application. As shown in FIG. 6, the first switch circuit 510 is a fourth transistor W1, the second switch circuit 520 is a fifth transistor W2, the third switch circuit 530 is a sixth transistor W3, the fourth switch circuit 540 is a seventh transistor W4, the fifth switch circuit 550 is an eighth transistor W5, and the sixth switch circuit 560 is a ninth transistor W6.

Specifically, in the reset and initialization stage, the fourth transistor W1, the sixth transistor W3 and the eighth transistor W5 are turned on, and the fifth transistor W2, the seventh transistor W4 and the ninth transistor W6 are turned off. In the data write stage, the fourth transistor W1, the sixth transistor W3 and the eighth transistor W5 are turned off, and the fifth transistor W2, the seventh transistor W4 and the ninth transistor W6 are turned on.

It should be noted that the types of the fourth transistor W1, the fifth transistor W2, the sixth transistor W3, the seventh transistor W4, the eighth transistor W5 and the ninth transistor W6 are not specifically limited in the embodiment, and any type combination capable of implementing the turn-on and turn-off performance of each transistor in a specific stage is within the scope of the embodiment.

Exemplarily, with continued reference to FIG. 6, the sixth transistor W3 and the seventh transistor W4 are first-type transistors, the fourth transistor W1, the fifth transistor W2, the eighth transistor W5 and the ninth transistor W6 are second-type transistors, gates of the fourth transistor W1, the seventh transistor W4 and the eighth transistor W5 are each electrically connected to a first control signal terminal LA, and gates of the fifth transistor W2, the sixth transistor W3 and the ninth transistor W6 are each electrically connected to a second control signal terminal XLA.

In the reset and initialization stage, a first control signal output from the first control signal terminal LA and a second control signal output from the second control signal terminal XLA control the fourth transistor W1, the sixth transistor W3 and the eighth transistor W5 to be turned on and the fifth transistor W2, the seventh transistor W4 and the ninth transistor W6 to be turned off.

In the data write stage, the first control signal output from the first control signal terminal LA and the second control signal output from the second control signal terminal XLA control the fourth transistor W1, the sixth transistor W3 and the eighth transistor W5 to be turned off and the fifth transistor W2, the seventh transistor W4 and the ninth transistor W6 to be turned on.

In this way, the turn-on and turn-off of the fourth transistor W1, the fifth transistor W2, the sixth transistor W3, the seventh transistor W4, the eighth transistor W5 and the ninth transistor W6 can be implemented by the first control signal and the second control signal, and on the premise of ensuring that the functions of the fourth transistor W1, the fifth transistor W2, the sixth transistor W3, the seventh transistor W4, the eighth transistor W5 and the ninth transistor W6 are implemented normally and the source driving circuit operates normally, the number of the control signal terminals is reduced, and the structure of the source driving circuit is simplified.

Specifically, as shown in FIG. 6, the sixth transistor W3 and the seventh transistor W4 may be, for example, P-type transistors. The fourth transistor W1, the fifth transistor W2, the eighth transistor W5 and the ninth transistor W6 may be, for example, N-type transistors. Based on the characteristic of being turned on at a logic low level of the P-type transistor and the characteristic of being turned on at a logic high level of the N-type transistor, it may be set that in the reset and initialization stage, the first control signal terminal LA outputs a logic high-level signal and the second control signal terminal XLA outputs a logic low-level signal, so as to control the fourth transistor W1, the sixth transistor W3 and the eighth transistor W5 to be turned on and the fifth transistor W2, the seventh transistor W4 and the ninth transistor W6 to be turned off; in the data write stage, the first control signal terminal LA outputs a logic low-level signal and the second control signal terminal LA outputs a logic high-level signal, so as to control the fourth transistor W1, the sixth transistor W3 and the eighth transistor W5 to be turned off and the fifth transistor W2, the seventh transistor W4 and the ninth transistor W6 to be turned on.

Figure 7:
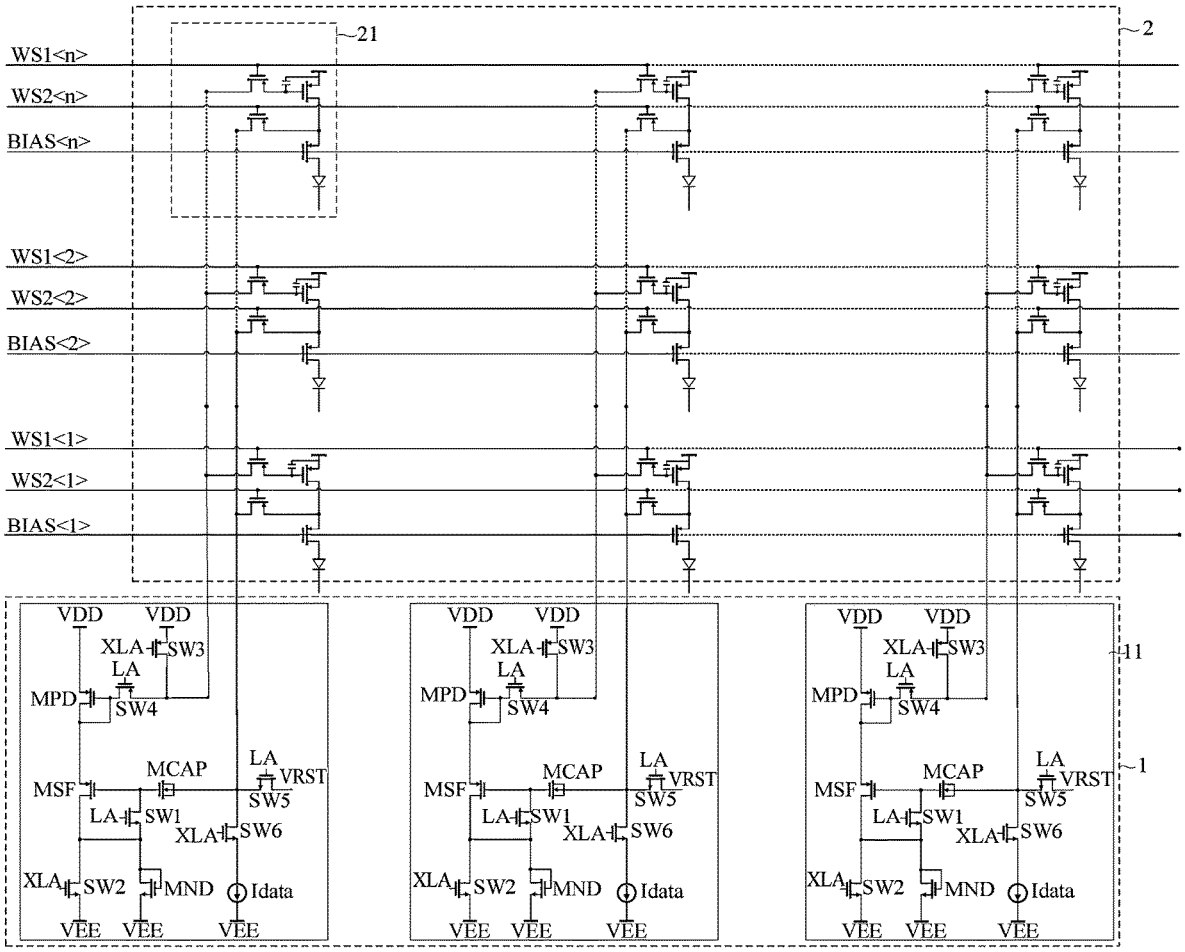
FIG. 7 is a structural diagram of a display device according to an embodiment of the present application.
Figure 8:
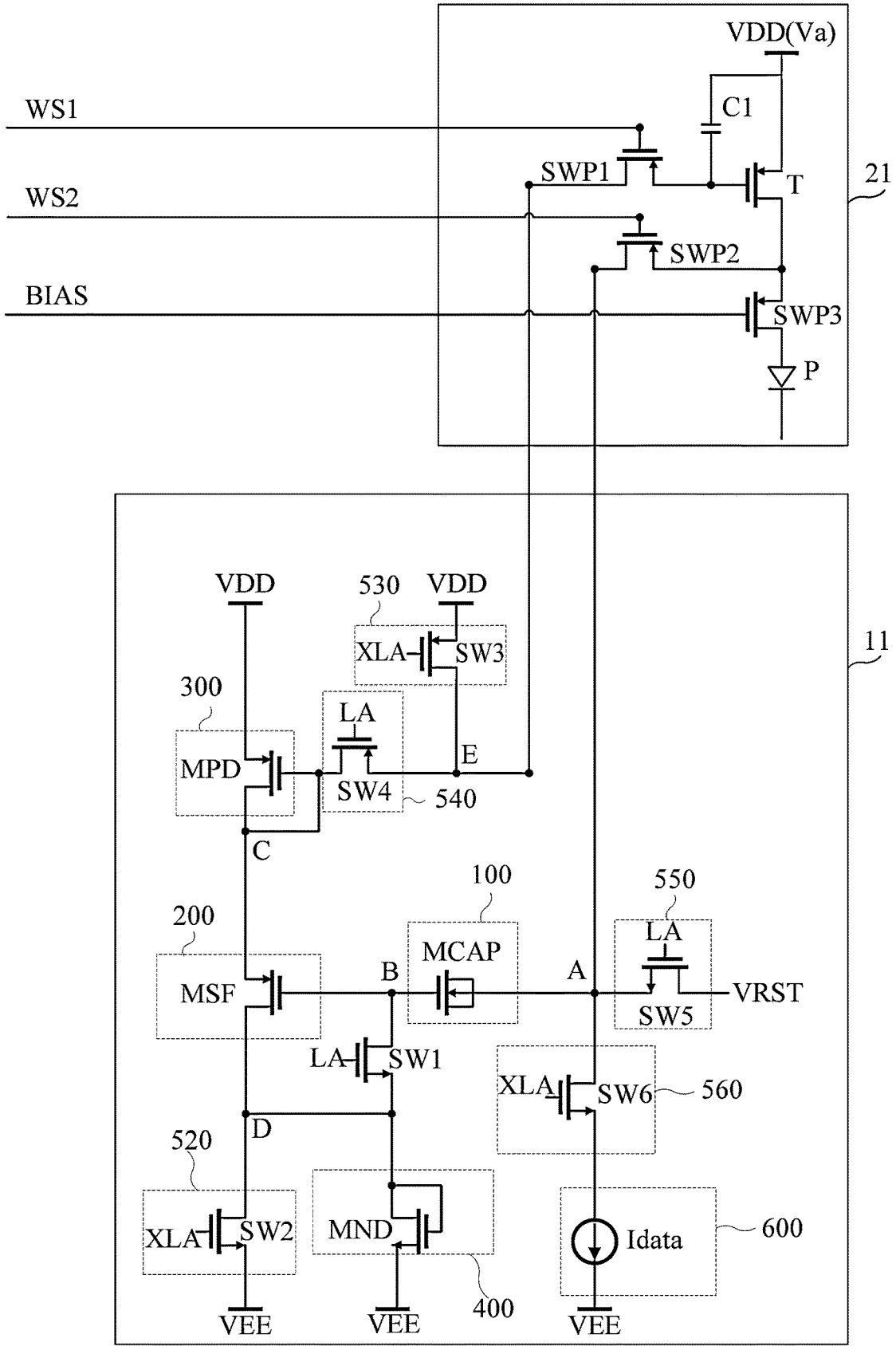
FIG. 8 is a schematic diagram showing a connection structure of a source driving circuit and a pixel driving circuit according to an embodiment of the present application.

FIG. 7 is a structural diagram of a display device according to an embodiment of the present application. As shown in FIG. 7, the display device includes a source driving circuit group 1 and a pixel driving circuit group 2. The source driving circuit group 1 includes multiple source driving circuits 11 provided by any one of the embodiments of the present application, and the pixel driving circuit group 2 includes multiple pixel driving circuits 21. Each of the multiple source driving circuits 11 is electrically connected to at least one of the multiple pixel driving circuits 21. FIG. 8 is a schematic diagram showing a connection structure of a source driving circuit and a pixel driving circuit according to an embodiment of the present application. As shown in FIG. 8, each of the multiple pixel driving circuits 21 includes a drive transistor T, a seventh switch circuit SWP1, an eighth switch circuit SWP2, a ninth switch circuit SWP3 and an electricity storage circuit C1. The seventh switch circuit SWP1 is electrically connected between a gate of the drive transistor T and a fifth node D in a corresponding source driving circuit 11, and the seventh switch circuit SWP1 is configured to form a conductive pathway between the gate of the drive transistor T and the fifth node D in the corresponding source driving circuit 11 in a reset and initialization stage and a data write stage. The eighth switch circuit SWP2 is electrically connected between a drain of the drive transistor T and a first node A in the corresponding source driving circuit 11, and the eighth switch circuit SWP2 is configured to form a conductive pathway between the drain of the drive transistor T and the first node A in the corresponding source driving circuit 11 in the reset and initialization stage and the data write stage. The ninth switch circuit SWP3 is electrically connected between the drain of the drive transistor T and an anode of a light-emitting diode P, and the ninth switch circuit SWP3 is configured to form a conductive pathway between the drain of the drive transistor T and the anode of the light-emitting diode P in the reset and initialization stage and a light emission stage. The electricity storage circuit C1 is electrically connected between the gate of the drive transistor T and a first voltage signal terminal Va, and the electricity storage circuit C1 is configured to adjust a gate voltage of the drive transistor T. A source of the drive transistor T is electrically connected to a positive power supply signal terminal VDD, and the drive transistor is configured to drive the light-emitting diode P to emit light in the light emission stage.

It should be noted that the seventh switch circuit SWP1, the eighth switch circuit SWP2 and the ninth switch circuit SWP3 may be any form of switch structure, which is not specifically limited in the embodiment. Specifically, as shown in FIG. 8, the seventh switch circuit SWP1 may be a tenth transistor, a gate of the tenth transistor is electrically connected to a first scanning signal terminal WS1, a first electrode of the tenth transistor is electrically connected to the fifth node D in the corresponding source driving circuit 11, and a second electrode of the tenth transistor is electrically connected to the gate of the drive transistor T. The eighth switch circuit SWP2 may be an eleventh transistor, a gate of the eleventh transistor is electrically connected to a second scanning signal terminal WS2, a first electrode of the eleventh transistor is electrically connected to the first node A in the corresponding source driving circuit 11, and a second electrode of the eleventh transistor is electrically connected to the drain of the drive transistor T. The ninth switch circuit SWP3 may be a twelfth transistor, a gate of the twelfth transistor is electrically connected to a third scanning signal terminal BIAS, a first electrode of the twelfth transistor is electrically connected to the drain of the drive transistor T, and a second electrode of the twelfth transistor is electrically connected to an anode of a light-emitting element P.

It should further be noted that the specific circuit structure of the pixel driving circuit 21 is not limited to the 4T1C structure shown in FIGS. 7 and 8 which is merely given as an example here and not for limitation. It is to be understood that regardless of the type of the pixel driving circuit, the first node A of the source driving circuit 11 is electrically connected to the drain of the drive transistor T, and the fifth node E is electrically connected to the gate of the drive transistor T.

In addition, the illustration is performed, not for limitation, by only taking the example in which the first switch circuit 510, the third switch circuit 530, the fifth switch circuit 550 and the second voltage dividing circuit 400 are N-type transistors, the second switch circuit 520, the fourth switch circuit 540, the sixth switch circuit 560, the first voltage dividing circuit 300, the seventh switch circuit SWP1, the eighth switch circuit SWP2 and the ninth switch circuit SWP3 are P-type transistors, the first switch circuit 510, the third switch circuit 530 and the fifth switch circuit 550 are simultaneously controlled by the first control signal terminal LA, and the second switch circuit 520, the fourth switch circuit 540 and the sixth switch circuit 560 are simultaneously controlled by the second control signal terminal XLA. Any optional combination of various components provided by the embodiments of the present application is within the scope of the embodiment. The display device provided by the embodiments of the present application includes the source driving circuit of any one of the embodiments of the present application, has the technical features of the source driving circuit provided by any one of the embodiments of the present application, and has the same or corresponding beneficial effects as the source driving circuit included by the display device, which are not repeated here.

Referring to FIG. 7, the multiple pixel driving circuits 21 are arranged in a matrix, and each of the multiple source driving circuits 11 is electrically connected to one column of pixel driving circuits 21 among the multiple pixel driving circuits 21.

It should be noted that the display device generally adopts a row-by-row scanning manner to display an image normally. Therefore, the pixel driving circuits 21 in the same column scan in a time-division manner, and source driving circuits 11 electrically connected to the pixel driving circuits in the same column 21 may respectively drive the corresponding pixel driving circuit 21 in different periods, so that no signal interference and other problems appear.

Exemplarily, with continued reference to FIG. 8, the positive power supply signal terminal VDD may be reused as the first voltage signal terminal Va.

In this way, on the premise of ensuring that the effective threshold voltage compensation of the drive transistor T in the pixel driving circuit 21 is achieved, the number of control signals is reduced, the number of corresponding signal terminals is reduced, and the circuit structure and signal design of the overall circuit are simplified.

Figure 9:
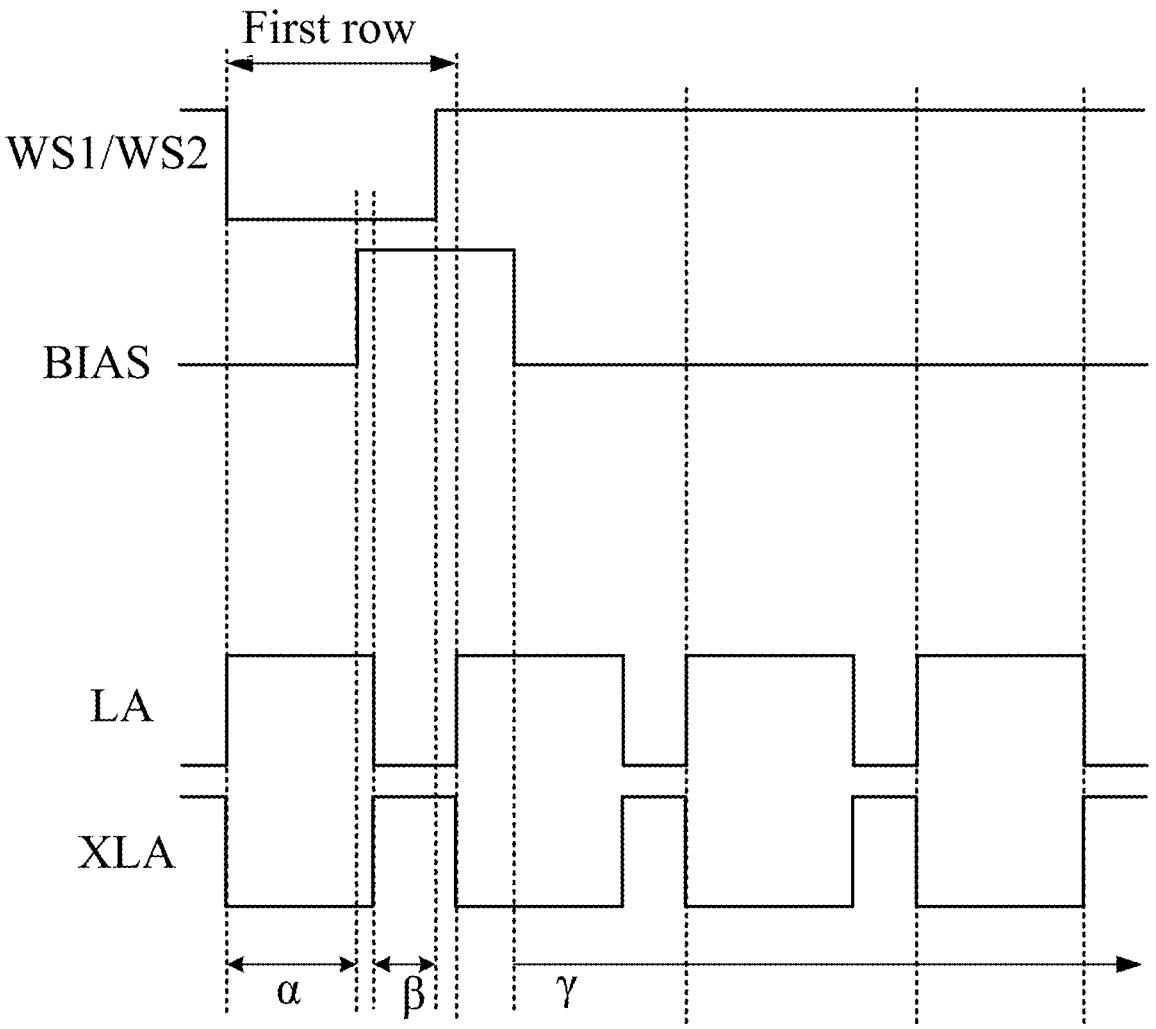
FIG. 9 is a timing diagram of circuits in FIG. 8.
Figure 10:
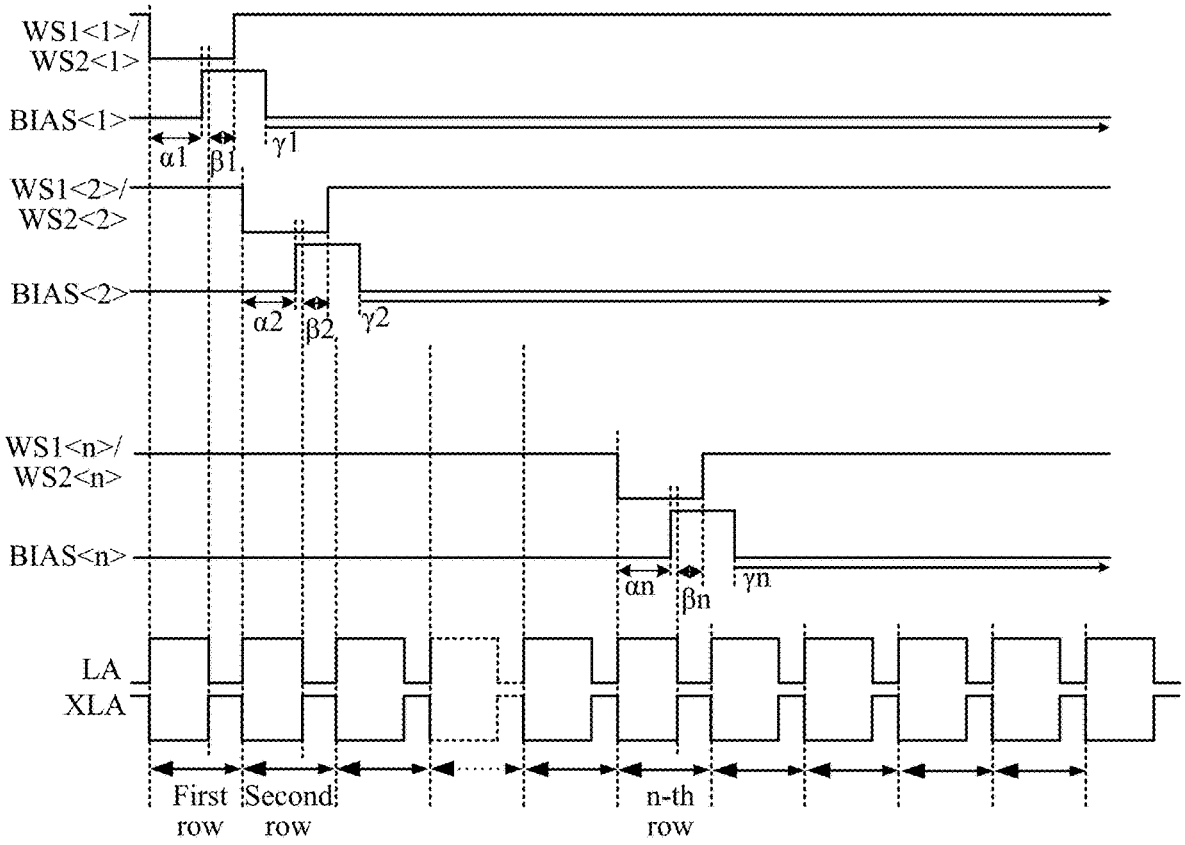
FIG. 10 is a timing diagram according to an embodiment of the present application.

Exemplarily, FIG. 9 is a timing diagram of circuits in FIG. 8. It should be noted that FIG. 9 only shows the driving timing of a row of pixel driving circuits. It may be understood that for the driving timing of multiple rows of pixel driving circuits, each row of pixel driving circuits has the same driving timing as the driving timing in FIG. 9, and only the row-by-row scanning requirement needs to be simultaneously followed. Referring specifically to FIG. 10, the specific operation of a row of pixel driving circuits is merely described with reference to FIG. 9. As shown in FIGS. 8 and 9, in the reset and initialization stage α, the first control signal terminal LA provides a logic high-level signal, the second control signal terminal XLA provides a logic low-level signal, the first switch circuit 510, the third switch circuit 530 and the fifth switch circuit 550 are turned on, the second switch circuit 520, the fourth switch circuit 540 and the sixth switch circuit 560 are turned off, the first scanning signal terminal WS1 provides a logic low-level signal, the second scanning signal terminal WS2 provides a logic low-level signal, the third scanning signal terminal BIAS provides a logic low-level signal, and the seventh switch circuit SWP1, the eighth switch circuit SWP2 and the ninth switch circuit SWP3 are turned on. The fourth switch circuit 540 and the voltage isolation circuit 100 in the source driving circuit 11 divide the overall circuit in FIG. 8 into a left-side part and a right-side part, similar to FIG. 2 and with the only difference that FIG. 2 illustrates only the drive transistor T in the pixel driving circuit, while FIG. 8 illustrates a specific structure of the pixel driving circuit. Therefore, the method for determining potentials of the second node B, the third node C and the fourth node D in the left-side part of FIG. 8 is the same as the method of FIG. 2, which is not repeated here. For the right-side part in FIG. 8, the voltage of the first node A is VRST, the drain of the drive transistor T in the pixel driving circuit 21 is electrically connected to the first node A via the turned-on eighth switch circuit SWP2, and the voltage of the drain of the drive transistor T is equal to the voltage VRST of the first node A. The gate of the drive transistor T in the pixel driving circuit 21 is electrically connected to the fifth node E via the turned-on seventh switch circuit SWP1, and the voltage of the gate of the drive transistor T is equal to the voltage VDD of the fifth node E. The anode of the light-emitting diode P is electrically connected to the first node A via the turned-on ninth switch circuit SWP3 and the turned-on eighth switch circuit SWP2, the voltage of the anode of the light-emitting diode P is equal to the voltage VRST of the first node A, and the light-emitting diode P is in a reset stage and does not emit light.

In the data write stage β, the first control signal terminal LA provides a logic low-level signal, the second control signal terminal XLA provides a logic high-level signal, the first switch circuit 510, the third switch circuit 530 and the fifth switch circuit 550 are turned off, the second switch circuit 520, the fourth switch circuit 540 and the sixth switch circuit 560 are turned on, the first scanning signal terminal WS1 provides a logic low-level signal, the second scanning signal terminal WS2 provides a logic low-level signal, the third scanning signal terminal BIAS provides a logic high-level signal, the seventh switch circuit SWP1 and the eighth switch circuit SWP2 are turned on, and the ninth switch circuit SWP3 is turned off. A loop is established by the source driving circuit 11 and the drive transistor T, the seventh switch circuit SWP1 and the eighth switch circuit SWP2 in the pixel driving circuit 21, and the detailed process is the same as the loop establishment process in FIG. 2, which is not repeated here. After the loop is established, the current flowing through the drive transistor T is equal to the data current output from the current source 600, and at this time, the data current output from the current source 600 is set as a light emission current, and then the drive current flowing through the drive transistor T is equal to the data current. It is to be understood that the electricity storage circuit C1 is charged in the loop establishment process. In the light emission stage γ, only on the basis of the state of each component in the data write stage, the first scanning signal terminal WS1 provides a logic high-level signal, the second scanning signal terminal WS2 provides a logic high-level signal, the third scanning signal terminal BIAS provides a logic low-level signal, the seventh switch circuit SWP1 and the eighth switch circuit SWP2 are turned off, and the ninth switch circuit SWP3 is turned on. At this time, the source of the drive transistor T is electrically connected to the positive power supply signal terminal VDD, and the electricity storage circuit C1 maintains the gate voltage of the drive transistor T unchanged. Therefore, the gate-source voltage of the drive transistor T maintains unchanged, and the drive current generated by the drive transistor T is unchanged, specifically being a data current. The current flows into the anode of the light-emitting element P through the turned-on ninth switch circuit SWP3, so that the threshold voltage compensation of the drive transistor T is achieved.

Figure 11:
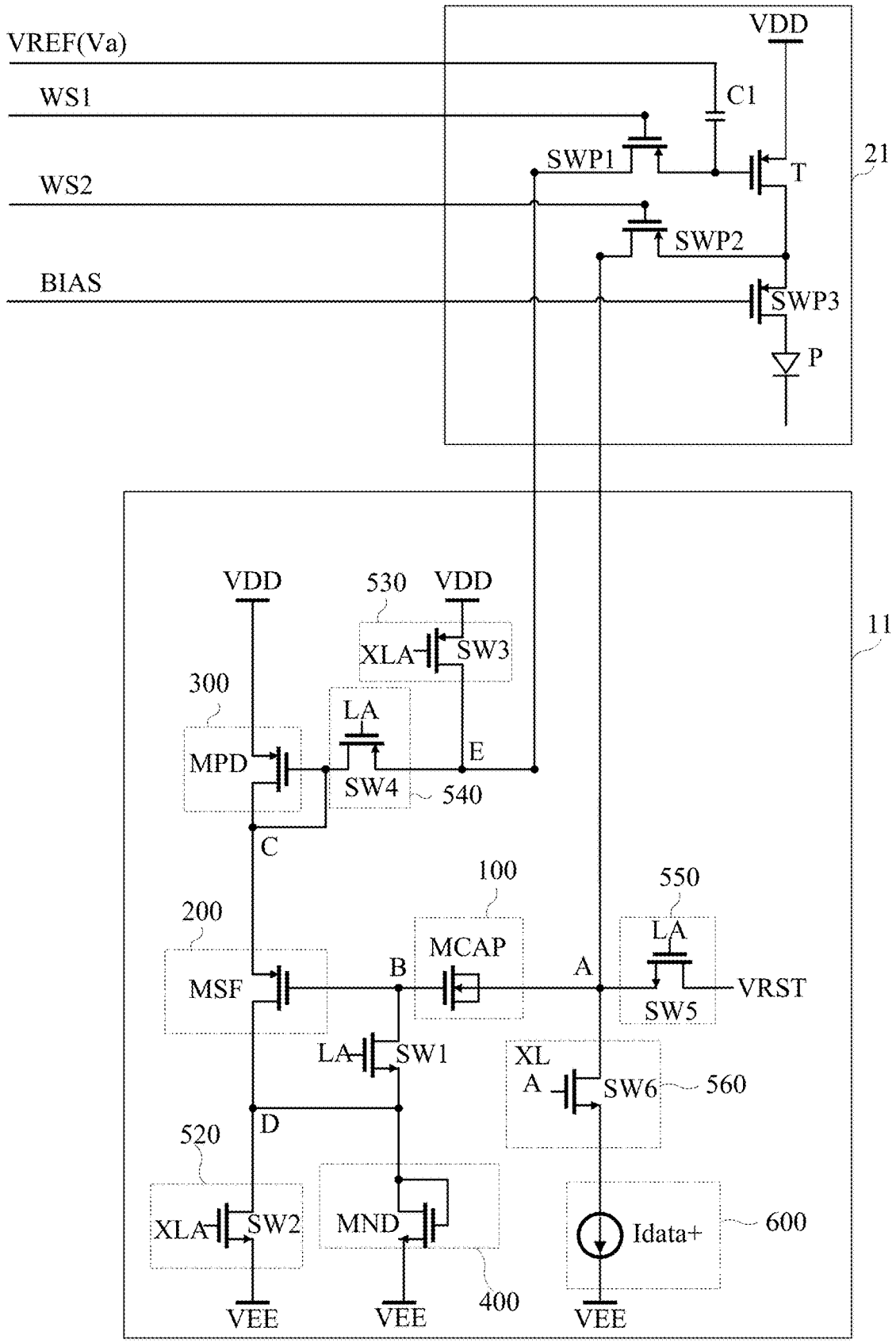
FIG. 11 is a schematic diagram showing another connection structure of a source driving circuit and a pixel driving circuit according to an embodiment of the present application.

Optionally, in other implementations of the embodiment, the first voltage signal terminal Va may be an external variable voltage source VREF, which is shown in FIG. 11.

It should be noted that the operation process of circuits in FIG. 11 is substantially the same as the operation process of circuits in FIG. 8, except that in the embodiment, the data current output from the current source 600 is greater than the light emission current required for light emission so as to accelerate the time for establishing the loop in the data write stage, and at this time, after the loop is established, the drive current flowing through the drive transistor is equal to the data current of the current source 600. To ensure that the current flowing into the anode of the light-emitting element P in the light emission stage is equal to the light emission current to achieve the threshold compensation of the drive transistor T, an output voltage of the first voltage signal terminal Va is reduced from a first signal to a second signal in the reset and initialization stage, and is recovered to the first signal before the ninth switch circuit is turned on in the light emission stage, so that after the loop is established, the gate voltage of the drive transistor T is increased by increasing the voltage of the first voltage signal terminal Va, the gate-source voltage difference of the drive transistor T is reduced, and thus the drive current of the drive transistor T is reduced to the light emission current. For ease of description, the period after the seventh switch circuit and the eighth switch circuit are turned off and before the ninth switch circuit is turned on in the light emission stage may be configured as a drive transistor gate voltage adjustment stage. Specifically, in the drive transistor gate voltage adjustment stage, the seventh switch circuit SWP1, the eighth switch circuit SWP2 and the ninth switch circuit SWP3 are controlled to be turned off, and then the voltage of the first voltage signal terminal Va is increased, so that the current flowing into the anode of the light-emitting element P in the light emission stage is the light emission current, and thus the threshold voltage compensation of the drive transistor T is achieved.

Figure 12:
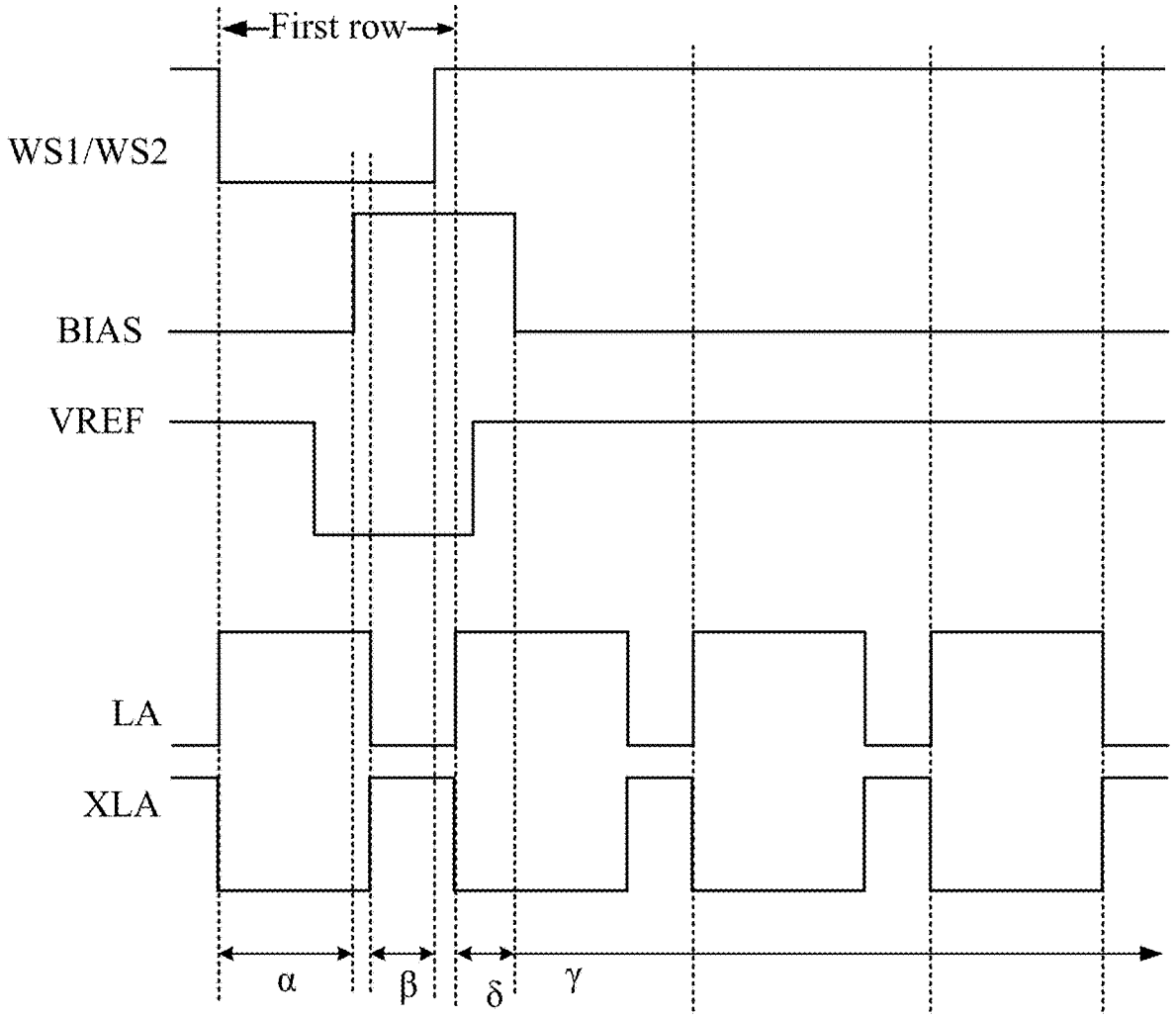
FIG. 12 is a timing diagram of circuits shown in FIG. 11.

Exemplarily, FIG. 12 is a timing diagram of circuits in FIG. 11. As shown in FIG. 12, the process for achieving the threshold compensation of the drive transistor using the circuit structure shown in FIG. 11 includes: a reset and initialization stage α, a data write stage β, a drive transistor gate voltage adjustment stage δ and a normal light emission stage γ. It is to be understood that in the embodiment, the drive transistor gate voltage adjustment stage δ and the normal light emission stage α form a light emission stage.

In the reset and initialization stage α, the first control signal terminal LA provides a logic high-level signal, the second control signal terminal XLA provides a logic low-level signal, the first switch circuit 510, the third switch circuit 530 and the fifth switch circuit 550 are turned on, the second switch circuit 520, the fourth switch circuit 540 and the sixth switch circuit 560 are turned off, the first scanning signal terminal WS1 provides a logic low-level signal, the second scanning signal terminal WS2 provides a logic low-level signal, the third scanning signal terminal BIAS provides a logic low-level signal, and the seventh switch circuit SWP1, the eighth switch circuit SWP2 and the ninth switch circuit SWP3 are turned on. The fourth switch circuit 540 and the voltage isolation circuit 100 in the source driving circuit 11 divide the overall circuit in FIG. 11 into a left-side part and a right-side part, similar to FIG. 2 and with the only difference that FIG. 2 illustrates only the drive transistor T in the pixel driving circuit, while FIG. 11 illustrates a specific structure of the pixel driving circuit. Therefore, the method for determining potentials of the second node B, the third node C and the fourth node D in the left-side part of FIG. 11 is the same as the method of FIG. 2, which is not repeated here. For the right-side part in FIG. 11, the voltage of the first node A is VRST, the drain of the drive transistor T in the pixel driving circuit 21 is electrically connected to the first node A via the turned-on eighth switch circuit SWP2, and the voltage of the drain of the drive transistor T is equal to the voltage VRST of the first node A. The gate of the drive transistor T in the pixel driving circuit 21 is electrically connected to the fifth node E via the turned-on seventh switch circuit SWP1, and the voltage of the gate of the drive transistor T is equal to the voltage VDD of the fifth node E. In this period, the output voltage of the first voltage signal terminal Va is reduced from the first signal to the second signal, and at this time, the second signal is a preset initial voltage of a first voltage signal output terminal Va. The anode of the light-emitting diode P is electrically connected to the first node A via the turned-on ninth switch circuit SWP3 and the turned-on eighth switch circuit SWP2, the voltage of the anode of the light-emitting diode P is equal to the voltage VRST of the first node A, and the light-emitting diode P is in a reset stage and does not emit light.

In the data write stage β, the first control signal terminal LA provides a logic low-level signal, the second control signal terminal XLA provides a logic high-level signal, the first switch circuit 510, the third switch circuit 530 and the fifth switch circuit 550 are turned off, the second switch circuit 520, the fourth switch circuit 540 and the sixth switch circuit 560 are turned on, the seventh switch circuit SWP1 and the eighth switch circuit SWP2 are turned on, and the ninth switch circuit SWP3 is turned off. A loop is established by the source driving circuit 11 and the drive transistor T, the seventh switch circuit SWP1 and the eighth switch circuit SWP2 in the pixel driving circuit 21, and the specific process is the same as the loop establishment process in FIG. 2, which is not repeated here. After the loop is established, the drive current flowing through the drive transistor T is equal to the data current of the current source 600, and the drive current is greater than the light emission current. In this period, the electricity storage circuit C1 is charged, and the voltage of the first voltage signal terminal Va is kept as a second voltage signal.

In the drive transistor gate voltage adjustment stage δ, only on the basis of the state of each component in the data write stage, the first scanning signal terminal WS1 provides a logic high-level signal, the second scanning signal terminal WS2 provides a logic high-level signal, the seventh switch circuit SWP1 and the eighth switch circuit SWP2 are configured in off-state, the output voltage of the first voltage signal terminal Va is recovered to a first voltage signal, the gate voltage of the drive transistor T is increased, and the gate-source voltage of the drive transistor T is reduced to be equal to a gate-source voltage at the time of a required light emission current.

In the light emission stage γ, the third scanning signal terminal BIAS provides a logic low-level signal, the ninth switch circuit SWP3 is turned on, and the voltage of the first voltage signal terminal Va is kept as the first voltage signal. At this time, the source of the drive transistor T is electrically connected to the positive power supply signal terminal VDD, and the electricity storage circuit C1 maintains the gate voltage of the drive transistor T unchanged. Therefore, the gate-source voltage of the drive transistor T is kept unchanged, the drive current generated by the drive transistor T is equal to the required light emission current, and the current flows into the anode of the light-emitting element P through the turned-on ninth switch circuit SWP3, so that the threshold compensation of the drive transistor T is achieved.

Figure 13:
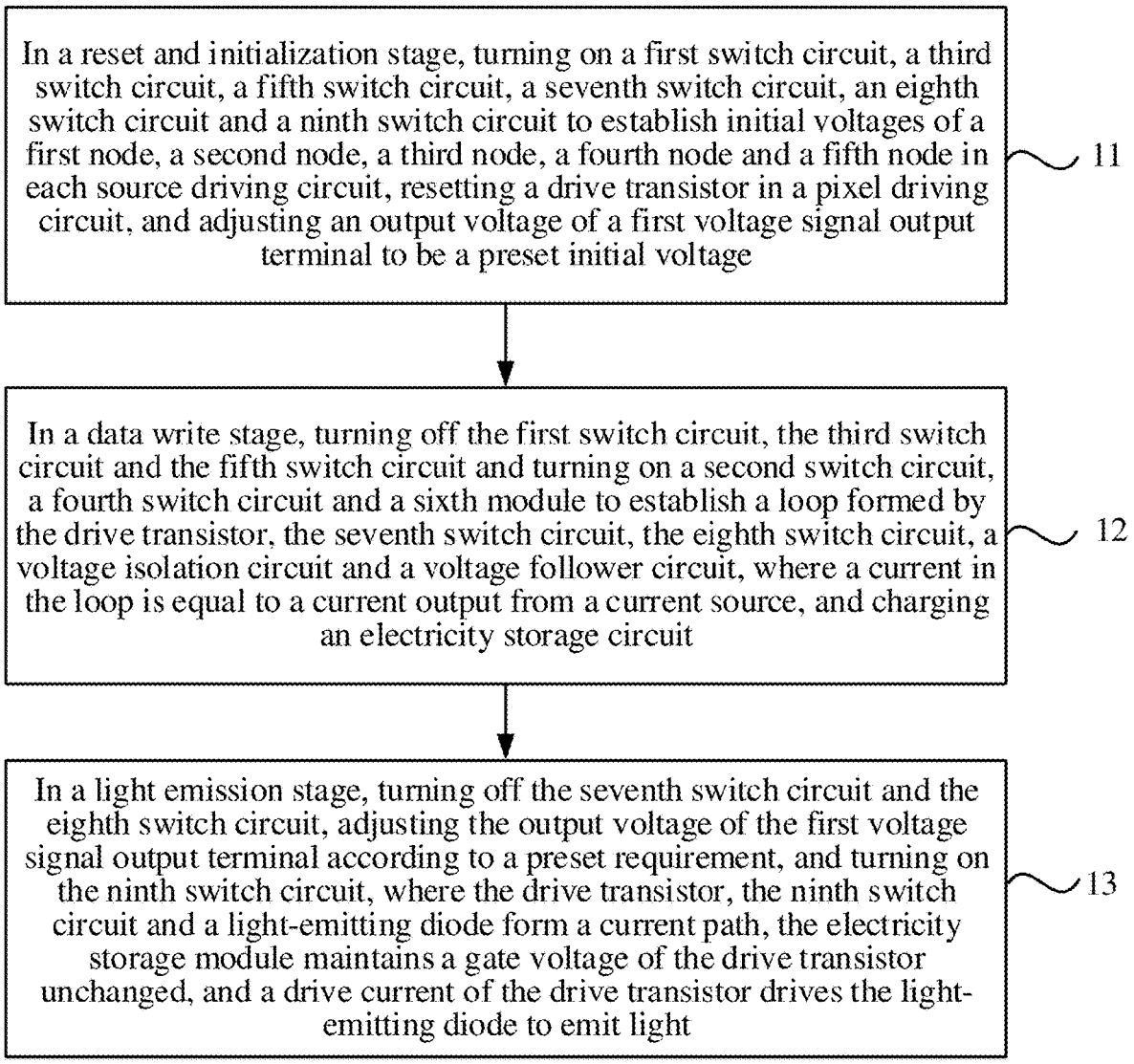
FIG. 13 is a flowchart of a pixel driving method according to an embodiment of the present application.

FIG. 13 is a flowchart of a pixel driving method according to an embodiment of the present application. The pixel driving method is applied to the display device provided by any one of the embodiments of the present application. As shown in FIG. 13, the pixel driving method may specifically include steps described below.

In step 11, in a reset and initialization stage, a first switch circuit, a third switch circuit, a fifth switch circuit, a seventh switch circuit, an eighth switch circuit and a ninth switch circuit are turned on to establish initial voltages of a first node, a second node, a third node, a fourth node and a fifth node in each source driving circuit; a drive transistor in a pixel driving circuit is reset; and an output voltage of a first voltage signal output terminal is adjusted to be a preset initial voltage.

The preset initial voltage is the output voltage of the first voltage signal output terminal preset by a designer according to actual circuit structure and timing requirements. It is to be understood that under different circuit structure and timing requirements, the preset initial voltage may have different values and may be obtained in different manners. For example, the preset initial voltage may be a fixed voltage signal continuously output from the first voltage signal output terminal, or may be a voltage signal obtained after adjusting a fixed voltage signal of the first voltage signal output terminal according to requirements.

In step 12, in a data write stage, the first switch circuit, the third switch circuit and the fifth switch circuit are turned off and a second switch circuit, a fourth switch circuit and a sixth switch circuit are turned on to establish a loop formed by the drive transistor, the seventh switch circuit, the eighth switch circuit, a voltage isolation circuit and a voltage follower circuit, where a current in the loop is equal to a current output from a current source; and an electricity storage circuit is charged.

In step 13, in a light emission stage, the seventh switch circuit and the eighth switch circuit are turned off, the output voltage of the first voltage signal output terminal is adjusted according to a preset requirement, and the ninth switch circuit is turned on, where the drive transistor, the ninth switch circuit and a light-emitting diode form a current path, the electricity storage circuit maintains a gate voltage of the drive transistor unchanged, and a drive current of the drive transistor drives the light-emitting diode to emit light.

The preset requirement is a rule preset by a designer and is related to the actual circuit structure and timing requirements. It is to be understood that the output voltage of the first voltage signal output terminal is transmitted to the electricity storage circuit, and the electricity storage circuit is connected to a gate of the drive transistor; therefore, the output voltage of the first voltage signal output terminal can indirectly adjust the gate voltage of the drive transistor, change the drive current of the drive transistor and then change a light emission current flowing into an anode of a light-emitting element. It can be seen that in the case where the light emission current required for light emission of the light-emitting element is not equal to a data current output from the current source, the light emission current may be adjusted by changing the output voltage of the first voltage signal output terminal; and similarly, in the case where the light emission current required for the light emission of the light-emitting element is equal to the data current output from the current source, the output voltage of the first voltage signal output terminal may be kept unchanged, so as to ensure that the light emission current finally flowing into the anode of the light-emitting element is equal to the data current.

According to the technical solution provided by the embodiment, in the reset and initialization stage, the first switch circuit, the third switch circuit, the fifth switch circuit, the seventh switch circuit, the eighth switch circuit and the ninth switch circuit are turned on to establish the initial voltages of the first node, the second node, the third node, the fourth node and the fifth node in each source driving circuit, the drive transistor in the pixel driving circuit is reset, and the output voltage of the first voltage signal output terminal is adjusted to be the preset initial voltage. In the data write stage, the first switch circuit, the third switch circuit and the fifth switch circuit are turned off and the second switch circuit, the fourth switch circuit and the sixth switch circuit are turned on to establish the loop formed by the drive transistor, the seventh switch circuit, the eighth switch circuit, the voltage isolation circuit and the voltage follower circuit, where the current in the loop is equal to the current output from the current source; and the electricity storage circuit is charged. In the light emission stage, the seventh switch circuit and the eighth switch circuit are turned off, the output voltage of the first voltage signal output terminal is adjusted according to the preset requirement, and the ninth switch circuit is turned on, where the drive transistor, the ninth switch circuit and the light-emitting diode form the current path, the electricity storage circuit maintains the gate voltage of the drive transistor unchanged, and a leakage current of the drive transistor drives the light-emitting diode to emit light. In this way, drive currents of all pixel driving circuits are equal to the data current output from the current source regardless of the threshold voltage of the drive transistor, and the current finally flowing into the light-emitting element is adjusted by an output signal of the first voltage signal output terminal to be equal to the required light emission current. Therefore, the external effective compensations for the threshold voltage drifts of the drive transistors are achieved, and the uniformities of the pixel driving circuits in the display device are improved.

Optionally, when a positive power supply signal terminal is reused as a first voltage signal terminal, the step in which the output voltage of the first voltage signal output terminal is adjusted to be the preset initial voltage includes: adjusting the output voltage of the first voltage signal output terminal to be an output voltage of the positive power supply signal terminal. The step in which the output voltage of the first voltage signal output terminal is adjusted according to the preset requirement includes: maintaining the output voltage of the first voltage signal output terminal unchanged.

That is, at this time, the preset initial voltage is the output voltage of the positive power supply signal terminal, and the preset requirement is maintaining the output voltage of the first voltage signal output terminal unchanged.

Alternatively, when a first voltage signal terminal is an external variable voltage source, the step in which the output voltage of the first voltage signal output terminal is adjusted to be the preset initial voltage includes: adjusting the output voltage of the first voltage signal output terminal to be reduced from a first signal to a second signal. Correspondingly, the step in which the output voltage of the first voltage signal output terminal is adjusted according to the preset requirement includes: adjusting an output signal of the first voltage signal output terminal to be recovered from the second signal to the first signal.

That is, at this time, the preset initial voltage is the second signal, and the preset requirement is recovering from the second signal to the first signal.

What is claimed is:

1. A source driving circuit, comprising:

a voltage isolation circuit, a voltage follower circuit, a first voltage dividing circuit, a second voltage dividing circuit, a first switch circuit, a second switch circuit, a third switch circuit, a fourth switch circuit, a fifth switch circuit, a sixth switch circuit and a current source;

wherein the voltage isolation circuit is electrically connected between a first node and a second node and is configured to isolate a voltage of the first node from a voltage of the second node;

wherein a first terminal of the voltage follower circuit is electrically connected to the second node, a second terminal of the voltage follower circuit is electrically connected to a third node, a third terminal of the voltage follower circuit is electrically connected to a fourth node, and the voltage follower circuit is configured to set a voltage of the third node to be varied with the voltage of the second node in a data write stage;

wherein the first voltage dividing circuit is electrically connected between the third node and a positive power supply signal terminal, and the first voltage dividing circuit is configured to adjust the voltage of the third node;

wherein the second voltage dividing circuit is electrically connected between the fourth node and a negative power supply signal terminal, and the second voltage dividing circuit is configured to adjust a voltage of the fourth node;

wherein the first switch circuit is electrically connected between the second node and the fourth node, and the first switch circuit is configured to form a conductive pathway between the second node and the fourth node in a reset and initialization stage;

wherein the second switch circuit is electrically connected between the fourth node and the negative power supply signal terminal, and the second switch circuit is configured to form a conductive pathway between the fourth node and the negative power supply signal terminal in the data write stage;

wherein the third switch circuit is electrically connected between a fifth node and the positive power supply signal terminal, the fifth node and the first node are electrically connected to a drive transistor of a pixel driving circuit, and the third switch circuit is configured to form a conductive pathway between the fifth node and the positive power supply signal terminal in the reset and initialization stage;

wherein the fourth switch circuit is electrically connected between the third node and the fifth node and is configured to form a conductive pathway between the third node and the fifth node in the data write stage;

wherein the fifth switch circuit is electrically connected between the first node and a reset signal terminal and is configured to form a conductive pathway between the first node and the reset signal terminal in the reset and initialization stage; and wherein the sixth switch circuit is electrically connected between the first node and the current source, and the sixth switch circuit is configured to form a conductive pathway between the first node and the current source in the data write stage;

wherein the current source is electrically connected between the sixth switch circuit and the negative power supply signal terminal and is configured to provide a data current.

2. The source driving circuit of claim 1, wherein the voltage isolation circuit comprises a capacitor.

3. The source driving circuit of claim 2, wherein the capacitor comprises a transistor capacitor, the transistor capacitor comprises a gate portion, a source portion and a drain portion, the source portion and the drain portion electrically connected to each other are configured as a first electrode of the capacitor, and the gate portion is configured as a second electrode of the capacitor.

4. The source driving circuit of claim 3, wherein the voltage follower circuit comprises a first transistor, a gate of the first transistor is electrically connected to the second node, a source of the first transistor is electrically connected to the third node, and a drain of the first transistor is electrically connected to the fourth node.

5. The source driving circuit of claim 1, wherein the first voltage dividing circuit and the second voltage dividing circuit are both resistors or transistors.

6. The source driving circuit of claim 5, wherein the first voltage dividing circuit and the second voltage dividing circuit are both transistors, the first voltage dividing circuit is a P-type second transistor, and the second voltage dividing circuit is an N-type third transistor;

wherein a gate and a drain of the P-type second transistor are both electrically connected to the third node, and a source of the P-type second transistor is electrically connected to the positive power supply signal terminal; and wherein a gate and a drain of the N-type third transistor are both electrically connected to the fourth node, and a source of the N-type third transistor is electrically connected to the negative power supply signal terminal.

7. The source driving circuit of claim 1, wherein the first switch circuit comprises a fourth transistor, the second switch circuit comprises a fifth transistor, the third switch circuit comprises a sixth transistor, the fourth switch circuit comprises a seventh transistor, the fifth switch circuit comprises an eighth transistor, and the sixth switch circuit comprises a ninth transistor.

8. The source driving circuit of claim 7, wherein the sixth transistor and the seventh transistor are first-type transistors, the fourth transistor, the fifth transistor, the eighth transistor and the ninth transistor are second-type transistors, gates of the fourth transistor, the seventh transistor and the eighth transistor are each electrically connected to a first control signal terminal, and gates of the fifth transistor, the sixth transistor and the ninth transistor are each electrically connected to a second control signal terminal;

wherein in the reset and initialization stage, a first control signal output from the first control signal terminal and a second control signal output from the second control signal terminal control the fourth transistor, the sixth transistor and the eighth transistor to be turned on and the fifth transistor, the seventh transistor and the ninth transistor to be turned off; and wherein in the data write stage, the first control signal output from the first control signal terminal and the second control signal output from the second control signal terminal control the fourth transistor, the sixth transistor and the eighth transistor to be turned off and the fifth transistor, the seventh transistor and the ninth transistor to be turned on.

9. A display device, comprising a source driving circuit group and a pixel driving circuit group, wherein the source driving circuit group comprises a plurality of source driving circuits, each of the plurality of source driving circuits comprises:

a voltage isolation circuit, a voltage follower circuit, a first voltage dividing circuit, a second voltage dividing circuit, a first switch circuit, a second switch circuit, a third switch circuit, a fourth switch circuit, a fifth switch circuit, a sixth switch circuit and a current source;

wherein the voltage isolation circuit is electrically connected between a first node and a second node and is configured to isolate a voltage of the first node from a voltage of the second node;

wherein a first terminal of the voltage follower circuit is electrically connected to the second node, a second terminal of the voltage follower circuit is electrically connected to a third node, a third terminal of the voltage follower circuit is electrically connected to a fourth node, and the voltage follower circuit is configured to set a voltage of the third node to be varied with the voltage of the second node in a data write stage;

wherein the first voltage dividing circuit is electrically connected between the third node and a positive power supply signal terminal, and the first voltage dividing circuit is configured to adjust the voltage of the third node;

wherein the second voltage dividing circuit is electrically connected between the fourth node and a negative power supply signal terminal, and the second voltage dividing circuit is configured to adjust a voltage of the fourth node;

wherein the first switch circuit is electrically connected between the second node and the fourth node, and the first switch circuit is configured to form a conductive pathway between the second node and the fourth node in a reset and initialization stage;

wherein the second switch circuit is electrically connected between the fourth node and the negative power supply signal terminal, and the second switch circuit is configured to form a conductive pathway between the fourth node and the negative power supply signal terminal in the data write stage;

wherein the third switch circuit is electrically connected between a fifth node and the positive power supply signal terminal, the fifth node and the first node are electrically connected to a drive transistor of a pixel driving circuit, and the third switch circuit is configured to form a conductive pathway between the fifth node and the positive power supply signal terminal in the reset and initialization stage;

wherein the fourth switch circuit is electrically connected between the third node and the fifth node and is configured to form a conductive pathway between the third node and the fifth node in the data write stage;

wherein the fifth switch circuit is electrically connected between the first node and a reset signal terminal and is configured to form a conductive pathway between the first node and the reset signal terminal in the reset and initialization stage; and wherein the sixth switch circuit is electrically connected between the first node and the current source, and the sixth switch circuit is configured to form a conductive pathway between the first node and the current source in the data write stage; and wherein the current source is electrically connected between the sixth switch circuit and the negative power supply signal terminal and is configured to provide a data current;

wherein the pixel driving circuit group comprises a plurality of pixel driving circuits, and each of the plurality of source driving circuits is electrically connected to at least one of the plurality of pixel driving circuits;

wherein each of the plurality of pixel driving circuits comprises the drive transistor, a seventh switch circuit, an eighth switch circuit, a ninth switch circuit and an electricity storage circuit;

wherein the seventh switch circuit is electrically connected between a gate of the drive transistor and a fifth node in a corresponding source driving circuit, and the seventh switch circuit is configured to form a conductive pathway between the gate of the drive transistor and the fifth node in the corresponding source driving circuit in the reset and initialization stage and the data write stage;

wherein the eighth switch circuit is electrically connected between a drain of the drive transistor and the first node in the corresponding source driving circuit, and the eighth switch circuit is configured to form a conductive pathway between the drain of the drive transistor and the first node in the corresponding source driving circuit in the reset and initialization stage and the data write stage;

wherein the ninth switch circuit is electrically connected between the drain of the drive transistor and an anode of a light-emitting diode, and the ninth switch circuit is configured to form a conductive pathway between the drain of the drive transistor and the anode of the light-emitting diode in the reset and initialization stage and a light emission stage;

wherein the electricity storage circuit is electrically connected between the gate of the drive transistor and a first voltage signal terminal, and the electricity storage circuit is configured to adjust a gate voltage of the drive transistor; and wherein a source of the drive transistor is electrically connected to a positive power supply signal terminal, and the drive transistor is configured to drive the light-emitting diode to emit light in the light emission stage.

10. The display device of claim 9, wherein the plurality of pixel driving circuits are arranged in a matrix, and each of the plurality of source driving circuits is electrically connected to one column of pixel driving circuits among the plurality of pixel driving circuits.

11. The display device of claim 9, wherein the seventh switch circuit comprises a tenth transistor, a gate of the tenth transistor is electrically connected to a first scanning signal terminal, a first electrode of the tenth transistor is electrically connected to the fifth node in the corresponding source driving circuit, and a second electrode of the tenth transistor is electrically connected to the gate of the drive transistor;

the eighth switch circuit comprises an eleventh transistor, a gate of the eleventh transistor is electrically connected to a second scanning signal terminal, a first electrode of the eleventh transistor is electrically connected to the first node in the corresponding source driving circuit, and a second electrode of the eleventh transistor is electrically connected to the drain of the drive transistor; and the ninth switch circuit comprises a twelfth transistor, a gate of the twelfth transistor is electrically connected to a third scanning signal terminal, a first electrode of the twelfth transistor is electrically connected to the drain of the drive transistor, and a second electrode of the twelfth transistor is electrically connected to an anode of a light-emitting element.

12. The display device of claim 9, wherein the positive power supply signal terminal is reused as the first voltage signal terminal.

13. The display device of claim 9, wherein the first voltage signal terminal comprises an external variable voltage source.

14. A pixel driving method, the pixel driving method being applied to a display device, wherein the display device comprises: a source driving circuit group and a pixel driving circuit group, wherein the source driving circuit group comprises a plurality of source driving circuits, each of the plurality of source driving circuits comprises:

a voltage isolation circuit, a voltage follower circuit, a first voltage dividing circuit, a second voltage dividing circuit, a first switch circuit, a second switch circuit, a third switch circuit, a fourth switch circuit, a fifth switch circuit, a sixth switch circuit and a current source;

wherein the voltage isolation circuit is electrically connected between a first node and a second node and is configured to isolate a voltage of the first node from a voltage of the second node;

wherein a first terminal of the voltage follower circuit is electrically connected to the second node, a second terminal of the voltage follower circuit is electrically connected to a third node, a third terminal of the voltage follower circuit is electrically connected to a fourth node, and the voltage follower circuit is configured to set a voltage of the third node to be varied with the voltage of the second node in a data write stage;

wherein the first voltage dividing circuit is electrically connected between the third node and a positive power supply signal terminal, and the first voltage dividing circuit is configured to adjust the voltage of the third node;

wherein the second voltage dividing circuit is electrically connected between the fourth node and a negative power supply signal terminal, and the second voltage dividing circuit is configured to adjust a voltage of the fourth node;

wherein the first switch circuit is electrically connected between the second node and the fourth node, and the first switch circuit is configured to form a conductive pathway between the second node and the fourth node in a reset and initialization stage;

wherein the second switch circuit is electrically connected between the fourth node and the negative power supply signal terminal, and the second switch circuit is configured to form a conductive pathway between the fourth node and the negative power supply signal terminal in the data write stage;

wherein the third switch circuit is electrically connected between a fifth node and the positive power supply signal terminal, the fifth node and the first node are electrically connected to a drive transistor of a pixel driving circuit, and the third switch circuit is configured to form a conductive pathway between the fifth node and the positive power supply signal terminal in the reset and initialization stage;

wherein the fourth switch circuit is electrically connected between the third node and the fifth node and is configured to form a conductive pathway between the third node and the fifth node in the data write stage;

wherein the fifth switch circuit is electrically connected between the first node and a reset signal terminal and is configured to form a conductive pathway between the first node and the reset signal terminal in the reset and initialization stage; and wherein the sixth switch circuit is electrically connected between the first node and the current source, and the sixth switch circuit is configured to form a conductive pathway between the first node and the current source in the data write stage; and wherein the current source is electrically connected between the sixth switch circuit and the negative power supply signal terminal and is configured to provide a data current;

wherein the pixel driving circuit group comprises a plurality of pixel driving circuits, and each of the plurality of source driving circuits is electrically connected to at least one of the plurality of pixel driving circuits;

wherein each of the plurality of pixel driving circuits comprises the drive transistor, a seventh switch circuit, an eighth switch circuit, a ninth switch circuit and an electricity storage circuit;

wherein the seventh switch circuit is electrically connected between a gate of the drive transistor and a fifth node in a corresponding source driving circuit, and the seventh switch circuit is configured to form a conductive pathway between the gate of the drive transistor and the fifth node in the corresponding source driving circuit in the reset and initialization stage and the data write stage;

wherein the eighth switch circuit is electrically connected between a drain of the drive transistor and the first node in the corresponding source driving circuit, and the eighth switch circuit is configured to form a conductive pathway between the drain of the drive transistor and the first node in the corresponding source driving circuit in the reset and initialization stage and the data write stage;

wherein the ninth switch circuit is electrically connected between the drain of the drive transistor and an anode of a light-emitting diode, and the ninth switch circuit is configured to form a conductive pathway between the drain of the drive transistor and the anode of the light-emitting diode in the reset and initialization stage and a light emission stage;

wherein the electricity storage circuit is electrically connected between the gate of the drive transistor and a first voltage signal terminal, and the electricity storage circuit is configured to adjust a gate voltage of the drive transistor; and wherein a source of the drive transistor is electrically connected to a positive power supply signal terminal, and the drive transistor is configured to drive the light-emitting diode to emit light in the light emission stage;

wherein the pixel driving method comprises:

wherein in the reset and initialization stage, turning on the first switch circuit, the third switch circuit, the fifth switch circuit, the seventh switch circuit, the eighth switch circuit and the ninth switch circuit to establish initial voltages of the first node, the second node, the third node, the fourth node and the fifth node in each source driving circuit, resetting the drive transistor in the pixel driving circuit, and adjusting an output voltage of a first voltage signal output terminal to be a preset initial voltage;

wherein in the data write stage, turning off the first switch circuit, the third switch circuit and the fifth switch circuit and turning on the second switch circuit, the fourth switch circuit and the sixth switch circuit to establish a loop formed by the drive transistor, the seventh switch circuit, the eighth switch circuit, the voltage isolation circuit and the voltage follower circuit, wherein a current in the loop is equal to a current output from the current source, and charging an electricity storage circuit; and wherein in a light emission stage, turning off the seventh switch circuit and the eighth switch circuit, adjusting the output voltage of the first voltage signal output terminal according to a preset requirement, and turning on the ninth switch circuit, wherein the drive transistor, the ninth switch circuit and the light-emitting diode form a current path, the electricity storage circuit maintains a gate voltage of the drive transistor unchanged, and a drive current of the drive transistor drives the light-emitting diode to emit light.

15. The pixel driving method of claim 14, wherein the positive power supply signal terminal is reused as the first voltage signal terminal, the adjusting the output voltage of the first voltage signal output terminal to be the preset initial voltage comprises:

adjusting the output voltage of the first voltage signal output terminal to be an output voltage of the positive power supply signal terminal; and the adjusting the output voltage of the first voltage signal output terminal according to the preset requirement comprises:

maintaining the output voltage of the first voltage signal output terminal unchanged.

16. The pixel driving method of claim 14, wherein the first voltage signal terminal comprises an external variable voltage source, the adjusting the output voltage of the first voltage signal output terminal to be the preset initial voltage comprises:

adjusting the output voltage of the first voltage signal output terminal to be reduced from a first signal to a second signal; and the adjusting the output voltage of the first voltage signal output terminal according to the preset requirement comprises:

adjusting an output signal of the first voltage signal output terminal to be recovered from the second signal to the first signal.

* * * * *